US005723850A

United States Patent [19]

Lambert

[11] Patent Number: 5,723,850

[45] Date of Patent: Mar. 3, 1998

[54] CASH DRAWER ASSEMBLY

[75] Inventor: Ronald D. Lambert, Indianapolis, Ind.

[73] Assignee: Loyal Manufacturing Corporation, Indianapolis, Ind.

[21] Appl. No.: 688,040

[22] Filed: Jul. 26, 1996

[51] Int. Cl.[6] ..... G07G 1/00

[52] U.S. Cl. ..... 235/22; 235/7 R; 200/DIG. 38

[58] Field of Search ..... 200/61.61, DIG. 38; 235/7 R, 10, 22; 312/222, 245, 270.3, 249.4, 307, 308, 333, 334.7, 334.47

[56] References Cited

U.S. PATENT DOCUMENTS

| | | |
|---|---|---|
| 2,517,175 | 8/1950 | Bremer . |
| 3,628,724 | 12/1971 | Showers . |
| 3,839,886 | 10/1974 | Watson . |
| 4,101,745 | 7/1978 | Smith . |
| 4,182,539 | 1/1980 | Busch . |
| 4,268,076 | 5/1981 | Itoi . |
| 4,424,426 | 1/1984 | Ishii . |
| 4,603,239 | 7/1986 | Ishii . |
| 4,642,449 | 2/1987 | Baitz et al. . |
| 4,720,611 | 1/1988 | Ishii . |
| 5,111,394 | 5/1992 | Hilles et al. . |
| 5,371,344 | 12/1994 | Buie et al. . |
| 5,372,417 | 12/1994 | Buie et al. . |

*Primary Examiner*—Stuart N. Hecker
*Attorney, Agent, or Firm*—Barnes & Thornburg

[57] ABSTRACT

A cash drawer assembly includes a housing having an interior region and a drawer received in the interior region for sliding movement between closed and open positions. The housing has a symmetrical construction so that the drawer can be received by the interior region of the housing when the housing is in an over-table position on a top surface of a counter or when the housing is inverted and mounted beneath the counter in an under-table position. The housing includes a rear wall formed to include a slot that is centered relative to the sides and relative to the top and bottom of the housing. A tongue extends rearwardly from a rear panel of the drawer. The tongue extends through the slot when the drawer is in the closed position independent of whether the housing is in the over-table or under-table position. A latching assembly catches the tongue when the drawer is in the closed position to lock the drawer in the closed position. A compression spring extends forwardly from the rear wall of the housing and the tongue extends through an interior region of the compression spring when the drawer is in the closed position.

47 Claims, 10 Drawing Sheets

CASH DRAWER ASSEMBLY

BACKGROUND AND SUMMARY OF THE INVENTION

The present invention relates to point of sale systems, and particularly to a cash drawer assembly of a point of sale system that holds a money tray for organizing, storing, and securing cash. More particularly, the present invention relates to a cash drawer assembly including a housing having an interior region and a cash drawer slidably mounted to the housing for spring-actuated movement relative to the housing between an open position extending in front of the housing to present the money tray to a clerk and a closed position having the cash drawer and the money tray received in the interior region of the housing so that the front of the cash drawer is generally flush with the front of the housing.

Point of sale systems including cash drawer assemblies having a cash drawer that can extend from a housing to an open position presenting a storage compartment are known in the art. Such cash drawers are typically lockable in a closed position when the cash drawer is received in the interior region of the housing to restrict access to the contents of the cash drawer and are typically yieldably biased outwardly toward the open position. It is known to provide locking mechanisms for cash drawer assemblies for retaining the cash drawer in the closed position and for releasing the cash drawer so that the cash drawer can move to the open position when desired.

It is also known to provide a switch positioned to lie between the housing and the cash drawer for indicating the position of the cash drawer relative to the housing and providing an electrical signal in response thereto indicating to a personal computer or other monitor when the cash drawer is positioned at the closed position. Additionally, it is known to provide a latch mechanism for latching the cash drawer in the closed position, the latch mechanism including a movable latch member and a detector for detecting movement of the movable latch member. For example, U.S. Pat. Nos. 4,101,745 to Smith and 4,603,239 to Ishii show cash drawer assemblies having such detectors.

An improved cash drawer assembly should provide these advantages while additionally maximizing the versatility and ease of use of the cash drawer assembly and maximizing the reliability of the cash drawer assembly by minimizing the number of moving parts and minimizing the wear of the moving parts. What is needed is a cash drawer assembly that can be easily used on an upwardly-facing top surface of a counter and can be mounted to a downwardly-facing surface beneath the counter. The latching mechanism of the improved cash drawer assembly should be configured to minimize undesired forces acting upon the cash drawer and acting upon the moving parts of the latching mechanism in order to minimize wear of the cash drawer assembly and thereby maximize the reliability and the longevity of the cash drawer assembly.

According to the present invention, a cash drawer assembly is provided. The cash drawer assembly includes a housing defining an interior region and having a front wall, a rear wall spaced apart from the front wall and positioned to lie behind the front wall, and spaced-apart first and second side walls connecting the front and rear walls. A cash drawer is slidably mounted to the housing for movement between an open position extending in front of the housing and a closed position in the interior region of the housing. A compression spring is attached to the rear wall and extends forwardly therefrom. The spring is spaced apart from the first side wall by a first distance and from the second side wall by a second distance, the first distance being generally equal to the second distance.

In preferred embodiments, the cash drawer assembly includes a housing having a front wall and a cash drawer slidably mounted to the housing by first and second drawer slides for movement between an open position extending forwardly past the front wall and a closed position having the cash drawer fully received in the interior region of the housing. The cash drawer also includes a front wall or front panel and when the cash drawer is in the closed position the front panel of the cash drawer is generally flush with the front wall of the housing.

The housing includes a top wall, a bottom wall spaced apart from the top wall and mounted to a top surface or a bottom surface of a counter, a rear wall connected to the top and bottom walls, and spaced-apart first and second side walls appended to each of the top, bottom, and rear walls. The cash drawer assembly further includes a compression drawer spring having a first end engaging the rear wall of the housing. The drawer spring extends forwardly therefrom to a second end engaging the rear panel of the cash drawer when the cash drawer is in the closed position. The drawer spring yieldably biases the cash drawer away from the closed position and toward the extended open position.

A latching mechanism is coupled to the housing and to the cash drawer. The latching mechanism is movable between a locked position preventing movement of the cash drawer relative to the housing and a release position allowing movement of the cash drawer relative to the housing. The latching mechanism includes a tongue attached to the rear panel of the cash drawer and extending rearwardly therefrom. The tongue is spaced apart from each of the first and second side panels of the cash drawer and is positioned to lie mid-way therebetween. The rear wall of the housing is formed to include an opening at a position spaced apart from each of the first and second side walls of the housing and positioned to lie mid-way therebetween. When the cash drawer is in the closed position, the tongue is received in the opening of the rear wall of the housing and extends rearwardly therethrough.

The drawer spring is spaced apart from each of the first and second side walls of the housing and is positioned to lie mid-way therebetween. Likewise, the drawer spring is spaced apart from the first and second side walls of the cash drawer and is positioned to lie midway therebetween. This "center-line mounting" of the drawer spring and of the tongue minimizes the torque applied to the drawer slides between the cash drawer and the housing by the tongue and the drawer spring when the cash drawer is locked in the closed position. Minimizing the torque applied to the drawer slides minimizes wear of the drawer slides and maximizes the lifetime of the drawer slides so that the cash drawer can repeatedly slide easily between the closed position and the open position.

The cash drawer is slidably mounted to the housing by a first drawer slide coupled to the first side wall of the housing and to the first side panel of the cash drawer and a second drawer slide coupled to the second side wall of the housing and the second side panel of the cash drawer. Each of the first and second drawer slides is spaced apart from the top of the housing and the bottom of the housing and each drawer slide is preferably positioned to lie mid-way between the top wall and the bottom wall of the housing. The "symmetrical construction" of the cash drawer assembly, including the mounting of the first and second drawer slides mid-way between top wall and the bottom wall of the housing, positioning of the opening in the rear wall of the housing mid-way between the first and second side walls of the housing, and the center-line mounting of the drawer spring and the tongue allows the housing to operate as an "invertible housing" that can be used either in an "over-table position" on a top surface of a counter or mounted in an "under-table position" beneath the counter.

As described above, the latching mechanism includes the tongue extending rearwardly from the rear panel of the cash drawer through the opening in the rear wall of the housing to engage a catch formed on a rotatable catch cam when the cash drawer is in the closed position and the latching mechanism is in the locked position. The latching mechanism also includes a pivotable latch engaging the catch cam to block rotation of the catch cam away from the catch position when the latching mechanism is locked. The drawer spring yieldably biases the cash drawer forwardly and operates through the cash drawer and the tongue to yieldably bias the catch cam toward the release position and against the pivotable latch when the catch cam is in the catch position.

The cash drawer assembly in accordance with the present invention includes a tension cam spring having a first end attached to the catch cam and a second end attached to the housing. The first and second ends are arranged so that the cam spring biases the catch cam toward the release position when the catch cam is in the release position and the drawer is away from the closed position so that the catch cam is positioned to receive the tongue when the drawer moves to the closed position. In addition, the cam spring biases the catch cam toward the catch position when the catch cam is in the catch position reducing the net force acting between the catch cam and the pivotable latch when the cash drawer assembly is closed.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which:

FIG. 7 is a top plan view of a second embodiment of a cash drawer assembly with portions broken away showing an extended cash drawer including a divider cooperating with the rear panel of the cash drawer to define an extra compartment positioned to lie behind the money tray for storing articles such as media, spare currency, rolled coins, weapons, and the like;

DETAILED DESCRIPTION OF THE DRAWINGS

Figure 1:
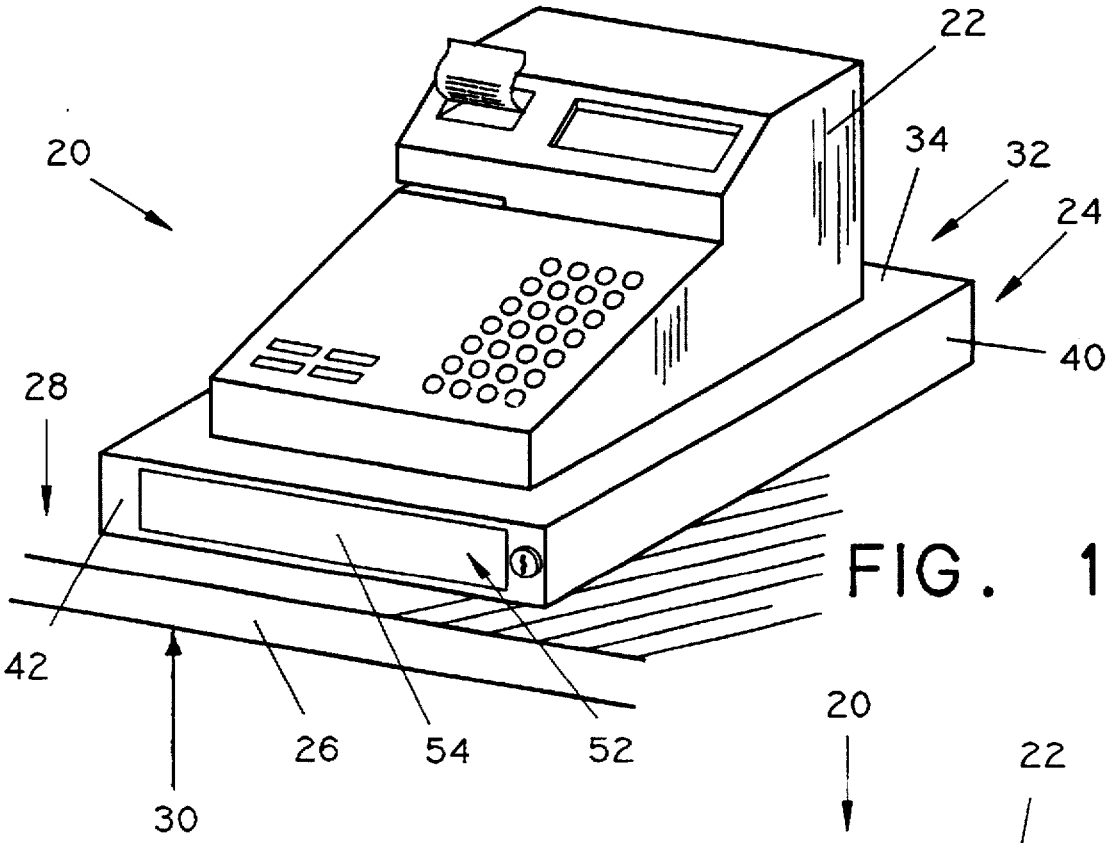
FIG. 1 is a perspective view of a point of sale system (POS system) showing a cash drawer assembly in accordance with the present invention and a PC having a keyboard resting on top of the cash drawer assembly, the cash drawer assembly being placed in an over-table position on a top surface of a counter.

A point of sale system 20 (hereinafter POS system 20) including a personal computer and a keyboard (hereinafter PC 22) and a cash drawer assembly 24 in accordance with the present invention is illustratively shown in FIG. 1 having cash drawer assembly 24 mounted to a top surface 28 of a counter 26. While illustrative POS system 20 includes PC 22 and cash drawer assembly 24, POS system 20 can also include, for example, a monitor, a printer, and peripherals such as a bar code scanner, a card swipe, and a pole display.

Figure 2:
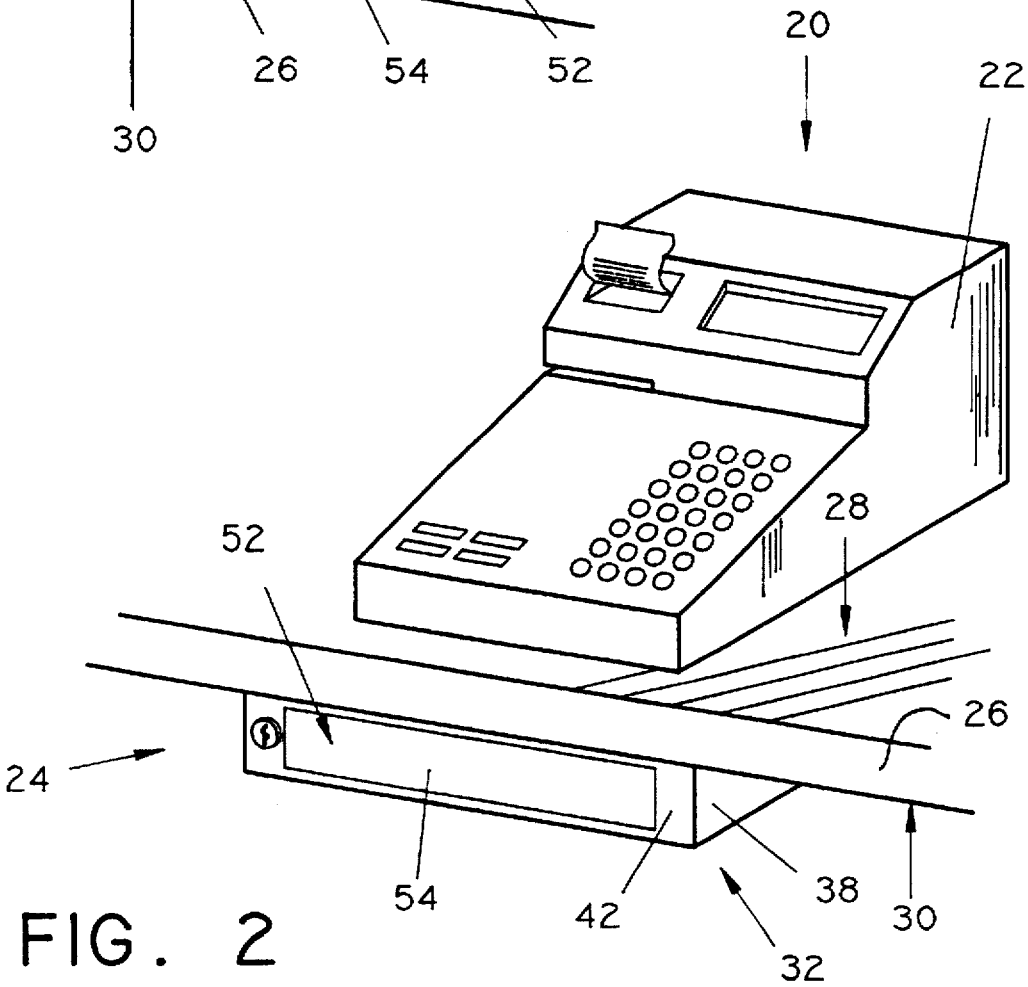
FIG. 2 is a view similar to FIG. 1 of the POS system showing the cash drawer assembly inverted from the orientation of FIG. 1 to an under-table position beneath the counter and mounted to a bottom surface of the counter.
Figure 3:
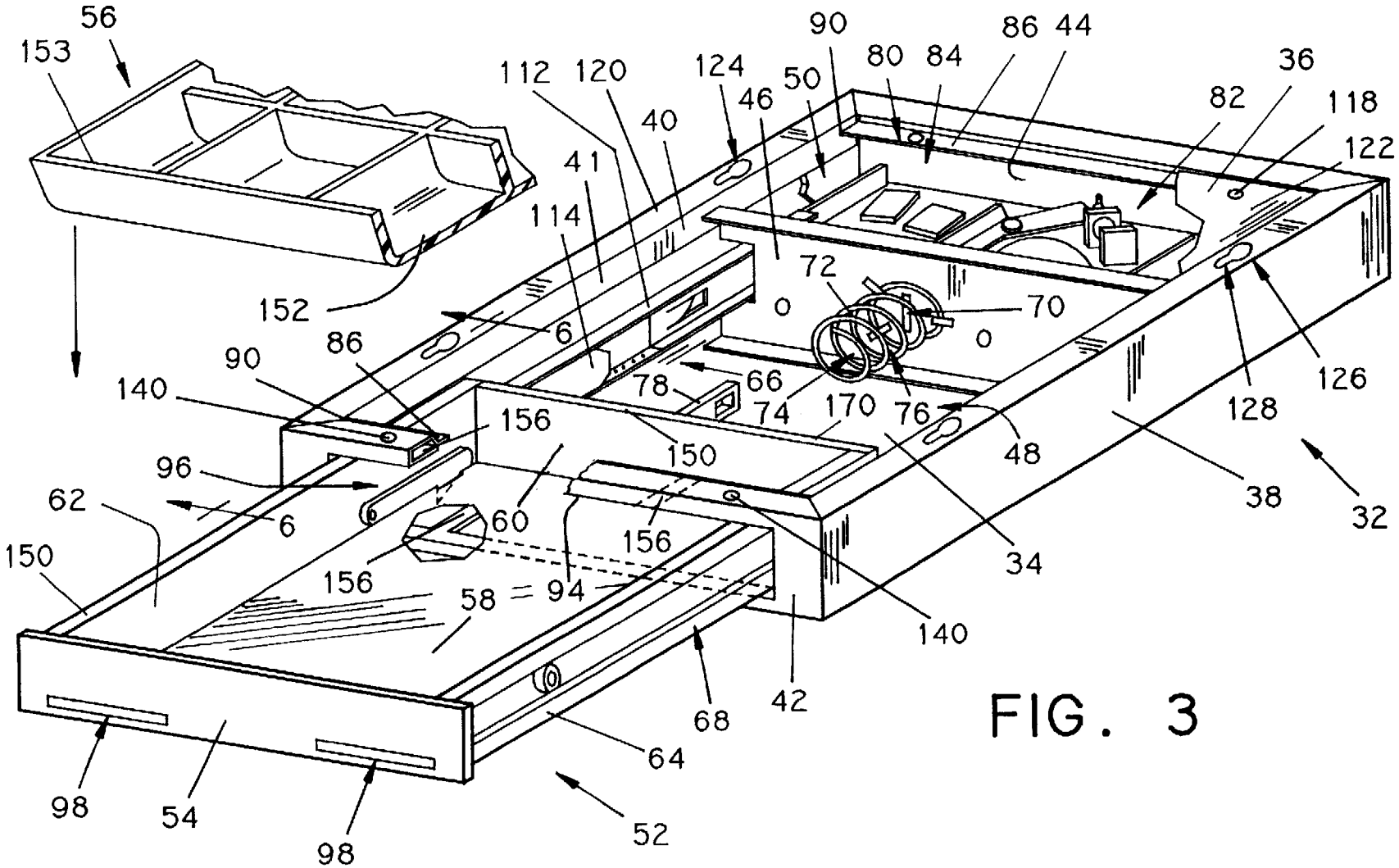
FIG. 3 is an exploded perspective view with portions broken away of the cash drawer assembly of FIG. 2 showing a cash drawer slidably mounted to a housing and positioned in an extended open position extending forwardly from a front wall of the housing, the cash drawer facing upwardly and carrying a money tray, the housing including a rear wall formed to include an opening, a drawer spring attached to the rear wall and extending forwardly therefrom, and a tongue attached to a rear panel of the cash drawer and extending rearwardly through the interior region of the drawer spring and through the opening in the rear wall to engage a latching mechanism positioned to lie behind the rear wall when the cash drawer is moved from the open position to a closed position.

Cash drawer assembly 24 includes a housing 32 having a top wall 34, a bottom wall 36 spaced apart from top wall 34 as shown in FIG. 3, a first side wall 38 shown in FIGS. 2 and 3, and a second side wall 40 spaced apart from first side wall 38 as shown in FIGS. 1 and 3. Housing 32 also includes a front wall 42, a back wall 44, and a rear wall 46 spaced apart from each of front wall 42 and back wall 44 and positioned to lie therebetween as shown in FIG. 3. Rear wall 46 cooperates with top wall 34, bottom wall 36, first side wall 38, second side wall 40, and front wall 42 to define an interior region 48 of housing 32. In addition, rear wall 46 cooperates with top wall 34, bottom wall 36, first side wall 38, second side wall 40, and back wall 44 to define a latching mechanism-receiving space 50.

Housing 32 can be mounted to counter 26 in an "over-table position" having top wall 34 positioned to lie above bottom wall 36 and bottom wall 36 resting on top surface 28 of counter 26 as shown in FIG. 1. In addition, housing 32 can be mounted in an "under-table position" having top wall 34 positioned to lie beneath bottom wall 36 and bottom wall 36 attached to a bottom surface 30 of counter 26 as shown in FIG. 2. Although cash drawer assemblies are commonly placed on top surfaces of counters as shown in FIG. 1 for illustrative housing 32, cash drawer assembly 24 may also be mounted to bottom surface 30 of counter 26 to hide cash drawer assembly 24 beneath counter 26 and to maximize the available working area on top surface 28 of counter 26. Cash drawer assembly 24 in accordance with the present invention can be either placed on top surface 28 or mounted to bottom surface 30 without modification of housing 32.

Illustrative cash drawer assembly 24 includes a cash drawer 52 slidably mounted to housing 32 as shown in FIG. 3. Cash drawer 52 is received in interior region 48 of housing 32 and slides therein between a closed position shown in FIGS. 1 and 2 having a front panel 54 of cash drawer 52 generally flush with front wall 42 of housing 32 and an open position having cash drawer 52 extending forwardly in front of front wall 42 of housing 32 as shown in FIG. 3. Cash drawer 52 carries a money tray 56 and when cash drawer 52 is in the open position money tray 56 is exposed and presented to a clerk operating POS system 20. Although illustrative cash drawer assembly 24 includes one cash drawer 52, it is within the scope of the invention as presently perceived to provide additional cash drawers (not shown) within a single housing 32 for use with either a single PC or with individual PCs for each cash drawer.

Cash drawer 52 includes a generally upwardly-facing drawer pan 58 and front panel 54, a rear panel 60, a first side panel 62, and a second side panel 64, each of which is connected to drawer pan 58 and extends upwardly therefrom as shown in FIG. 3 when cash drawer 52 faces upwardly. Cash drawer 52 is slidably mounted to housing 32 by first and second drawer slides 66. First drawer slide 66 is attached to first side wall 38 of housing 32 and first side panel 62 of cash drawer 52. Second drawer slide 66 is attached to second side wall 40 of housing 24 and second side panel 64 of cash drawer 52. Cash drawer 52 slides on first and second drawer slides 66 relative to housing 32 between the closed position shown in FIGS. 1 and 2 and the open position shown in FIG. 3.

Rear wall 46 of housing 32 is formed to include a tongue-receiving opening 70 as shown in FIG. 3. A drawer spring 72 is attached to rear wall 46 and extends forwardly therefrom. Preferred drawer spring 72 is a coil spring defining an interior region 74. Drawer spring 72 is preferably positioned to lie adjacent to tongue-receiving opening 70 so that interior region 74 of drawer spring 72 cooperates with tongue-receiving opening 70 of rear wall 46 to define a contiguous tongue-receiving space 76. A tongue 78 is attached to rear panel 60 of cash drawer 52 and extends rearwardly therefrom so that tongue 78 is received by tongue-receiving space 76 and extends rearwardly through tongue-receiving opening 70 when cash drawer 52 is in the closed position as shown best in FIG. 9.

Cash drawer assembly 24 additionally includes a latching assembly 80 positioned to lie in latching assembly-receiving space 50, latching assembly 80 including a latching mechanism 82 and a latching control assembly 84 as shown in FIG. 3. Latching mechanism 82 is movable between a locked position locking cash drawer 52 in the closed position relative to housing 32 preventing movement of cash drawer 52 relative to housing 32 and a release position allowing cash drawer 52 to slide relative to housing 32. Latching control assembly 84 controls the movement of latching mechanism 82 between the locked and release positions. Latching control assembly 84 can be moved between a "locked-open mode" preventing latching mechanism 82 from locking cash drawer 52 relative to housing 32 and a "locked-closed mode" locking cash drawer 52 in the closed position relative to housing 32. Latching control assembly 84 can also be moved to a "ready-to-operate mode" allowing latching mechanism 82 to move between the locked position and the release position at appropriate steps during a transaction both in response to movement of the cash drawer by a clerk to the closed position and in response to electrical signals received from PC 22.

Latching control assembly 84 will typically be moved to the ready-to-operate mode during normal operation of POS system 20. During the course of a transaction, the clerk will interface with PC 22 performing a selected series of operations that provide PC 22 with a prescribed set of user inputs. At a point during the transaction after PC 22 receives a preselected user input, PC 22 provides a cash drawer-release signal to latching control assembly 84 in response to the user input so that latching control assembly 84 moves latching mechanism 82 from the locked position to the release position. Drawer spring 72 yieldably biases cash drawer 52 away from rear wall 46 of housing 32 so that when latching mechanism 82 moves to the release position, cash drawer 52 automatically moves from the closed position to the open position. Thus, after the clerk provides a preselected user input to PC 22, cash drawer 52 automatically opens presenting money tray 56 to the clerk. Once the clerk completes the portion of the transaction requiring cash drawer 52 to be in the open position, the clerk manually returns cash drawer 52 to the closed position so that tongue 78 engages latching mechanism 82 and automatically moves latching mechanism 82 from the release position to the locked position locking cash drawer 52 in the closed position.

When latching control assembly 84 is in the locked-closed mode, latching control assembly 84 prevents latching mechanism 82 from responding to the cash drawer-release signal. Thus, even though the clerk performs the steps necessary to have PC 22 provide the cash drawer-release signal to latching control assembly 84, cash drawer 52 remains locked in the closed position. The locked-closed mode is particularly useful when a manager or other employee responsible for the contents of cash drawer 52 and money tray 56 wish to restrict access to cash drawer 52 and money tray 56.

When latching control assembly 84 is in the locked-open mode, latching control assembly 84 prevents latching mechanism 82 from moving to the locked position. Thus, when the clerk manually returns cash drawer 52 to the closed position, latching mechanism 82 remains in the release position so that drawer spring 72 automatically returns cash drawer 52 to the open position once cash drawer 52 is released by the clerk. The locked-open mode is particularly useful for keeping cash drawer 52 away from the closed position. For example, when POS system 20 is not in use and money tray 56 is empty it may be desirable to keep cash drawer 52 in the open position so that burglars or other unauthorized personnel in the vicinity of POS system 20 will not damage cash drawer assembly 24 in an attempt to force cash drawer 52 from the closed position to the open position.

As described above, housing 32 includes top wall 34, bottom wall 36, first side wall 38, second side wall 40, front wall 42, and back wall 44 as shown in FIGS. 1–3. Preferred housing 32 is a "wrap-around" housing made from a blank that is cut to a predetermined shape illustratively shown in FIG. 4. The blank is folded, bent, or otherwise shaped to form housing 32. The blank includes a pair of spacer bars 86, each of which defines a portion of bottom wall 36. Preferably, the blank is shaped using a stamping operation so that spacer bars 86 can be precisely cut to a desired size. Spacer bars 86 each have a first end 88 engaging first side wall 38 of housing 32 after housing 32 is shaped from the blank and a second end 90 engaging second side wall 40 of housing 32 after the housing is shaped from the blank as shown in FIGS. 3–5.

Figure 4:
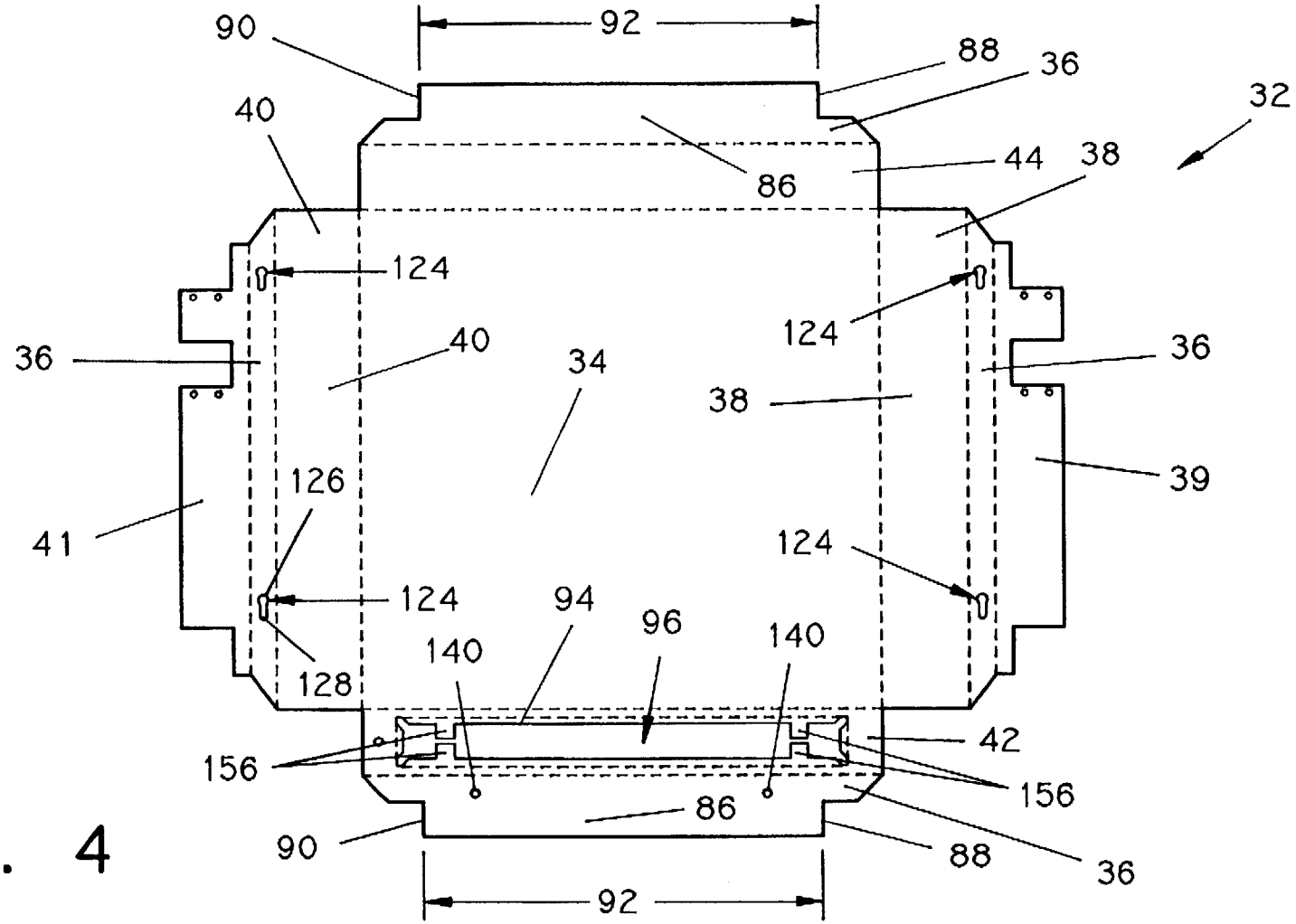
FIG. 4 is a top plan view of a unitary blank for forming the housing of the cash drawer assembly in accordance with the present invention using a "wrap-around" construction technique showing a generally square top wall of the housing, spaced-apart first and second side walls of the housing connected to the top wall, and spaced-apart front and back walls of the housing connected to the top wall, each of the front and back walls including a spacer bar having a precise length and engaging the first and second side walls after the blank is formed into the housing to establish the correct positions of the first and second side walls, thereby ensuring accurate and precise placement of the portions of the first and second side walls to which first and second drawer slides, connecting the cash drawer to the housing, are mounted.
Figure 5:
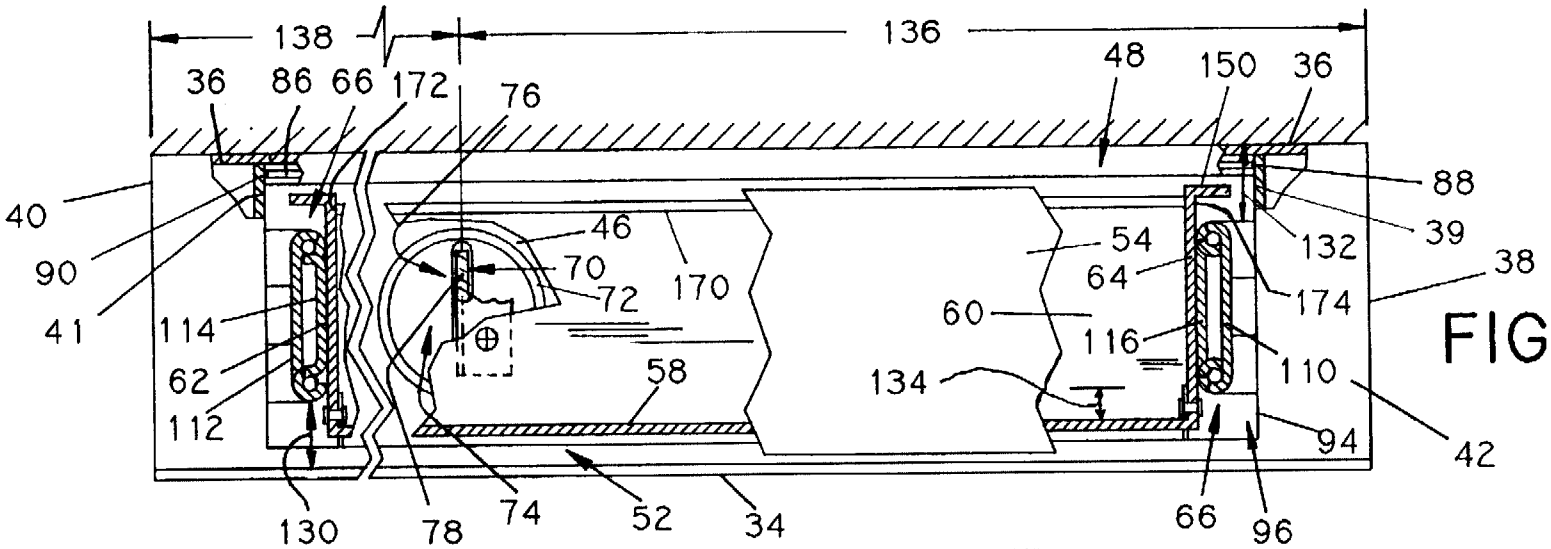
FIG. 5 is a front elevation view of the cash drawer assembly of FIG. 3 with portions broken away showing the "symmetrical construction" of the cash drawer assembly in which the first and second drawer slides are spaced apart from the top of the housing and from the bottom of the housing and are positioned to lie generally mid-way therebetween and including the "center-line mounting" of the tongue, the opening in the rear wall of the housing, and the drawer spring, which are spaced-apart from the first side of the housing and the second side of the housing and are positioned to lie generally mid-way therebetween, and are also spaced apart from the top of the housing and the bottom of the housing and are positioned to lie generally mid-way therebetween, the symmetrical construction allowing the housing to be mounted both in the under-table position having the bottom wall of the housing positioned to lie above the top wall of the housing and having the bottom wall of the housing attached to the bottom surface of the counter, the housing carrying the upwardly-facing cash drawer, and in the over-table position (shown in FIG. 1) having the bottom wall of the housing positioned to lie beneath the top wall of the housing and resting adjacent to the top surface of the counter, the housing being inverted relative to the cash drawer so that the cash drawer also faces upwardly when the housing is in the over-table position.

Spacer bars 86 are cut to a precise length 92 as shown in FIG. 4. Housing 32 is constructed from the blank by folding first side wall 38, second side wall 40, front wall 42, and back wall 44 downwardly. Portions of bottom wall 36 are appended to each of the front, back, and side walls and the portion of bottom wall 36 appended to front wall 42 is folded rearwardly, the portion of bottom wall 36 appended to back wall 44 and is folded forwardly, the portion of bottom wall 36 appended to first side wall 38 is folded inwardly, and the portion of bottom wall 36 appended to second side wall 48 and is folded inwardly. In addition, an inner portion 39 of first side wall 38 is appended to bottom wall 36 and is folded upwardly to engage first ends 88 of spacer bars 86 and an inner portion 41 of second side wall 40 is appended to top wall 36 and is folded upwardly to engage second ends 90 of spacer bars 86 as shown best in FIG. 5 so that the size of interior region 48 of housing 32 is established by spacer bars 86. Thus, housing 32 is constructed from the blank by wrapping around the wall portions to define housing 32.

Once housing 32 is shaped from the blank as described, the engaging ends of each of the folded panels at the corners of housing 32 can be joined, preferably by welding them together, to provide strength and rigidity to housing 32. This wrap-around construction technique is cost effective and easy to implement. In addition, housings reproduced using the wrap-around construction technique have close tolerances, particularly for the dimensions defined by spacer bars 86, so that the dimensional variations from housing to housing are negligible and the housings are readily reproducible.

Housing 32 is typically made from painted cold rolled steel, however it is within the scope of the invention as presently perceived to provide a housing made from any suitable material, preferably a material that can be shaped and formed as described above. For example, it may be desirable to form housing from stainless steel when cash drawer assembly 24 will be used in applications having demanding sanitary conditions such as around food, in corrosive atmospheres such as a car wash, or even simply for the cosmetic appearance of housing 32 made from stainless steel.

In preferred embodiments, cash drawer 52 is also formed using the wrap-around construction technique. Cash drawer 52 is formed to include a spacer bar 170 having a first end 172 and a second end 174 as shown best in FIG. 5. Spacer bar 170 is cut to a precise length and cash drawer 52 is formed by folding first side panel 62 upwardly to engage first end 172 of spacer bar 170 and folding second side panel 64 upwardly to engage second end 174 of spacer bar 170 so that the spacing between first and second side panels 62, 64 is established by spacer bar 170.

As described above, housing 32 includes rear wall 46 that cooperates with top wall 34, bottom wall 36, first side wall 38, second side wall 40, and front wall 42 of housing 32 to define interior region 48 of housing 32 as shown in FIGS. 3 and 5. Rear wall 46 is formed to include tongue-receiving opening 70 which is spaced apart from first side wall 38 by a distance 136 and from second side wall 40 by a distance 138 which is generally equal to distance 136 as shown best in FIG. 5 so that tongue-receiving opening 70 is generally mid-way between first and second side walls 38, 40.

Tongue 78 is mounted to rear panel 60 of cash drawer 52 and is positioned to lie generally mid-way between first and second side panels 62, 64 of cash drawer 52 and generally mid-way between first and second side walls 38, 40 of housing 32 as shown in FIG. 5 so that tongue 78 is received by tongue-receiving opening 70 as shown in FIGS. 5 and 9–11 when cash drawer 52 moves to the closed position. In addition, drawer spring 72 is mounted to rear wall 46 of housing 32 and is positioned to lie generally mid-way between first and second side walls 38, 40 as shown best in FIG. 5. Drawer spring 72 extends forwardly from rear wall 46 of housing 32 to engage rear panel 60 of cash drawer 52 to yieldably bias cash drawer 52 away from rear panel 60 and toward the open position.

The "center-line mounting" of tongue 78 and drawer spring 72 generally mid-way between first and second side walls 38, 40 of housing 32 and first and second side panels 62, 64 of cash drawer 52 as shown in FIG. 5 minimizes the torque applied to cash drawer 52 by drawer spring 72 and by tongue 78 when cash drawer 52 is locked in the closed position. Minimizing the torque applied to cash drawer 52 and housing 32 minimizes the forces applied to first and second slides 66 therebetween in directions other than the direction of movement of cash drawer 52 relative to housing 32. Minimizing the torque will thus operate to minimize the wear and maximize the operating life of slides 66.

Front wall 42 of housing 32 includes an edge 94 defining an opening 96 formed in front wall 42 providing cash drawer 52 with access to interior region 48 of housing 32 as shown in FIGS. 3–5. As described above, cash drawer 52 is slidably coupled to housing 32 by first and second drawer slides 66 so that cash drawer can move between the open position extended in front of front wall 42 of housing 32 as shown in FIG. 3 and the closed position having front panel 54 of cash drawer 52 generally flush with front wall 42 of housing 32 and received in opening 96 as shown in FIGS. 1 and 2. Each drawer slide 66 includes an outer track 110, 112 attached to first and second side walls 38, 40 of housing 32, respectively, and an inner track 114, 116 attached to first and second side panels 62, 64 of cash drawer 52, respectively, as shown best in FIG. 3 and 5.

Outer tracks 110, 112 are symmetrical and inner tracks 114, 116 are symmetrical so that outer track 110 can receive either inner track 114 or inner track 116 and outer track 112 can receive either inner track 114 or inner track 116. For example, when housing 32 is in the over-table position and cash drawer 52 faces upwardly, outer track 110 of first drawer slide 66 receives inner track 114 of first drawer slide 66 and outer track 112 of second drawer slide 66 receives inner track 116 of second drawer slide 66. However, when housing 32 is in the under-table position and cash drawer 52 faces upwardly as shown in FIGS. 2, 3, and 5, outer track 110 of first drawer slide 66 receives inner 116 of second drawer slide 66 and outer track 112 of second drawer slide 66 receives inner track 114 of first drawer slide 66.

Outer tracks 110, 112 are mounted to first and second side walls 38, 40, respectively, of housing 32 and are spaced apart from each of top wall 34 of housing 32 by a distance 130 and bottom wall 36 of housing 32 by a distance 132 as shown best in FIG. 5. Inner tracks 114, 116 are attached to first and second side panels 62, 64 of cash drawer 52 and are preferably spaced apart from drawer pan 58 of cash drawer 52 by a distance 134. In preferred embodiments, distances 130, 132 between outer tracks 110, 112 and top and bottom walls 34, 36 of housing 32 and distance 134 between inner tracks 114, 116 and drawer pan 58 of cash drawer 52 are sufficient to ensure that cash drawer 52 can slide relative to housing 32 without engaging edge 94 of opening 96, top wall 34 of housing 32, or bottom wall 36 of housing 32 when housing 32 is mounted in the under-table position having outer track 110 receiving inner track 116 and outer track 112 receiving inner track 114 and when housing 32 is in the over-table position having outer track 110 receiving inner track 114 and outer track 112 receiving inner track 116.

This "symmetrical construction" of cash drawer assembly 24, including the center-line mounting of tongue 78 and drawer spring 72 and the above-described placement of slides 66, allows housing 32 to be an "invertible housing" that can be easily mounted either in the over-table position to top surface 28 of counter 26 as shown in FIG. 1 or in the under-table position to bottom surface 30 of counter 26 as shown in FIG. 2. In each mounting position, cash drawer 52 is slidably received in housing 32 and faces upwardly therein for movement between the extended open position as shown in FIG. 3 and the closed position as shown in FIGS. 1 and 2 in which tongue 78 extends rearwardly through interior region 74 of drawer spring 72 and tongue-receiving opening 70 to engage latching mechanism 82. Thus, symmetrical construction allows inversion of cash drawer 52 relative to housing 32 so that housing 32 is an invertible housing that can be mounted either in the over-table and under-table positions.

In preferred embodiments, the interior portions of first and second side walls 38, 40 are slide mounting surfaces 39, 41, respectively, as shown in FIGS. 3–5, to which outer tracks 110, 112 of slides 66 are mounted. Preferably, outer track 110 is mounted to slide mounting surface 39 and outer track 112 is mounted to slide mounting surface 41 as shown best in FIG. 5. It can be seen that when housing 32 is shaped from the blank of FIG. 4, slide mounting surfaces 39, 41 engage ends 88, 90, respectively, of spacer bars 86 so that the positions of slide mounting surfaces 39, 41 and thus the positions of outer tracks 110, 112 are precise. Likewise, when cash drawer 52 is formed, spacer bar 170 ensures that the positioning of first and second side panels 62, 64 and thus the positions of inner tracks 114, 116 are also precise, ensuring that inner tracks 114, 116 engage and freely slide relative to outer tracks 110, 112 both when housing 32 is in the over-table position and when housing 32 is in the under-table position.

Bottom wall 36 is formed to include a rim 120 formed from the blank and integrally appended to top wall 34, first side wall 38, second side wall 40, front wall 32, and back wall 44 of housing 32 as shown in FIGS. 3 and 4. Bottom wall 36 also includes a plate 122 attached to rim 120 by threaded fasteners 118 as shown in FIG. 3.

Rim 120 is formed to include a plurality of keyhole-shaped openings 124 for mounting housing 32 to counter 26. Each opening 124 has an enlarged portion 126 and a retaining portion 128. When housing 32 is mounted in the under-table position, a plurality of fastening devices such as screws, nails, rivets, or other fastening devices having enlarged heads, are attached to bottom surface 30 of counter 26 and extend downwardly therefrom so that a gap is formed between the enlarged head of each fastening device and bottom surface 30.

Housing 32 is mounted by placing enlarged portions 126 of openings 124 over the fastening devices so that the heads of the fastening devices are received by enlarged portions 126 of openings 124 and extend therethrough and then sliding housing 32 rearwardly until the enlarged heads of the fastening devices are adjacent to retaining portion 128 of openings 124 trapping rim 120 of bottom wall 36 of housing 32 adjacent to retaining portions 128 between counter 26 and the enlarged heads of the fastening devices. In preferred embodiments, rim 120 is also formed to include openings 140 adjacent to front wall 42. Additional fastening devices (not shown) can be received in openings 140 to lock housing 32 into place so that housing 32 does not slide off of enlarged heads of the fastening devices received by keyhole-shaped openings 124.

When housing 32 is in the over-table position on top surface 28 of counter 26, housing 32 typically rests on top surface 28. If desired, rubber pedestals (not shown) can be attached to rim 120 to prevent sliding of housing 32 on top surface 28. Thus, when housing 32 is in the over-table position, top wall 34 of housing 32 is positioned to lie above bottom wall 36 of housing 32 and bottom wall 36 rests on top surface 28 of counter 26. When housing 32 is in the under-table position, top wall 34 is position to lie beneath bottom wall 36 and bottom wall 36 is attached to bottom surface 30 of counter 26.

As described above, cash drawer assembly 24 preferably includes money tray 56 resting in cash drawer 52 as shown in FIG. 3. In preferred embodiments, money tray 56 is formed to include a bottom 152 having runners (not shown) extending beneath money tray 56 to lift bottom 152 of money tray 56 above drawer pan 58 of cash drawer 52 forming a supplemental storage space 154 therebetween. Of course, drawer pan 58 and bottom 152 of money tray 56 can be formed so that no storage space is provided therebetween or money tray 56 can be provided having bottom 152 that is flat and that is lifted above drawer pan 58 of cash drawer 52 by blocks inserted between drawer pan 58 and bottom 152 of money tray 56 to form supplemental storage space 154. If desired, one or more slots 98 can be formed in front panel 54 of cash drawer 52, as shown, for example, in FIG. 3, for receiving media including credit card slips, coupons, or other items for storage in supplemental storage space 156.

As described above, supplemental storage space 154 can be used to store media (not shown) or other materials beneath money tray 56 if desired. However, when excessive media is stored in supplemental storage space 154, money tray 56 may be lifted so that a top edge 153 of money tray 56 is raised out of cash drawer 52. When this occurs on conventional cash drawer assemblies, the top edge of the money tray can inadvertently engage and "catch" on the edges of the housing stopping the forward movement of the money tray and the cash drawer before the cash drawer moves to the open position.

Figure 6:
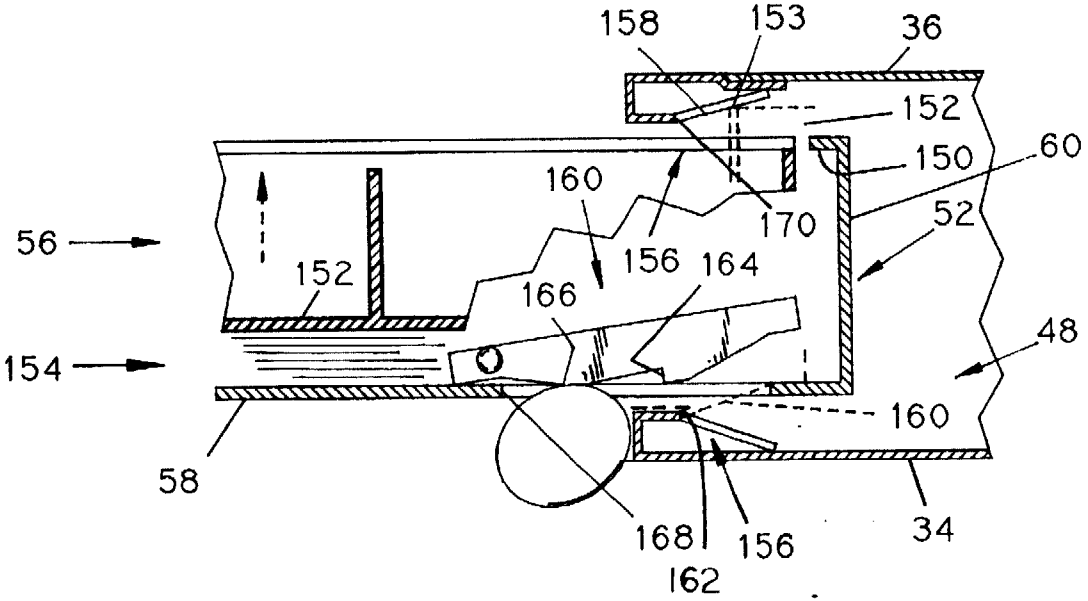
FIG. 6 is a sectional view taken along line 6—6 of FIG. 3 showing a tray anti-catch tab of the housing positioned to lie above the cash drawer and forming a ramp angling upwardly adjacent to the top of the housing and engaging the money tray as the cash drawer moves from the closed position to the open position to prevent the money tray from catching on the housing and inadvertently stopping the movement of the cash drawer from the closed position before the cash drawer reaches the open position, a stop formed on the housing and positioned to lie beneath the cash drawer, and a gravity operated drawer stop pivotably coupled to the cash drawer, the drawer stop cooperating with the stop on the housing to stop the forward movement of the cash drawer when the cash drawer reaches the open position, the gravity operated drawer stop being movable from a stop position (in phantom) to a release position disengaged from the stop of the housing so that the cash drawer can be removed from the housing when the drawer stop is in the release position.

Housing 32 of cash drawer assembly 24 in accordance with the present invention is formed to include a tray anti-catch tab 156 having a first end 170 appended to front wall 42 of housing 32 adjacent to edge 94 and extending rearwardly forming a ramp 158 that angles upwardly adjacent to bottom wall 36 of housing 32 as shown in FIG. 6. When cash drawer 52 moves from the closed position to the open position and top edge 153 of money tray 56 is lifted above rim 150 of cash drawer 52, top edge 153 of money tray 56 engages ramp 158 of tray anti-catch tab 156. Thus, instead of catching on an edge of the housing as can happen with conventional housings, top edge 153 will engage and ride along ramp 158 of tray anti-catch tab 156 to ensure that the movement of cash drawer 52 from the closed position to the open position is not hindered.

In preferred embodiments, tray anti-catch tabs 156 are formed adjacent to both top wall 34 and bottom wall 36 so that tray anti-catch tabs 156 are available to engage top edge 153 of money tray 56 both when housing 32 is mounted in the over-table position and when housing 32 is mounted in the under-table position. Although illustrative tray anti-catch tabs 156 angle from edge 94 of opening 96 toward bottom wall 36 or top wall 34, it is within the scope of the invention as presently perceived for tray anti-catch tabs 156 to extend rearwardly and generally horizontally so long as tabs 156 prevent money tray 56 from inadvertently catching on the edges of the housing 32.

Cash drawer 52 is additionally provided with a gravity-operated drawer stop 160 that cooperates with a stop 162 formed on housing 32 to stop the forward movement of cash drawer 52 away from the closed position when cash drawer 52 reaches the open position as shown in FIG. 6. Drawer stop 160 is formed to include a stop tab 164 that engages stop 162 of housing 32 to stop the forward motion of cash drawer 52. Drawer stop 160 is pivotably mounted to cash drawer 52 for movement between a stop position shown (in phantom) in FIG. 6 in which stop tab 164 engages stop 162 when cash drawer is in the open position and an upward release position moving stop tab 164 away from stop 162 so that cash drawer 52 can be pulled forwardly past the open position and removed from housing 32. When gravity operated drawer stop 160 is in the stop position, stop tab 164 extends downwardly past drawer pan 58 of cash drawer 52 through a slot 168 formed in drawer pan 58 so that stop tab 164 can engage stop 162 of housing 32. In preferred embodiments, cash drawer 52 is provided with two opposing drawer stops 160 on each side of cash drawer 52 that cooperate to stop the forward movement of cash drawer 52 at the open position.

Each drawer stop 160 is also formed to include a lug 166 that is manually contactable to pivot drawer stop 160 from the downward stop position to the upward release position when a contact force is applied thereto as shown in FIG. 6. Lug 166 is exposed beneath drawer pan 58 through slot 168 when drawer stop 160 is in the stop position so that the clerk can manually contact lug 166 to pivot drawer stop 160 from the stop position to the release position. Thus, to remove cash drawer 52 from housing 32, the clerk simply allows cash drawer to move to the open position, grasps the sides of cash drawer 52, manually contacts each lug 166 and applies a contact force thereto to pivot each drawer stop 160 to the release position, and then pulls cash drawer 52 forwardly to remove cash drawer 52 from housing 32.

Figure 7:
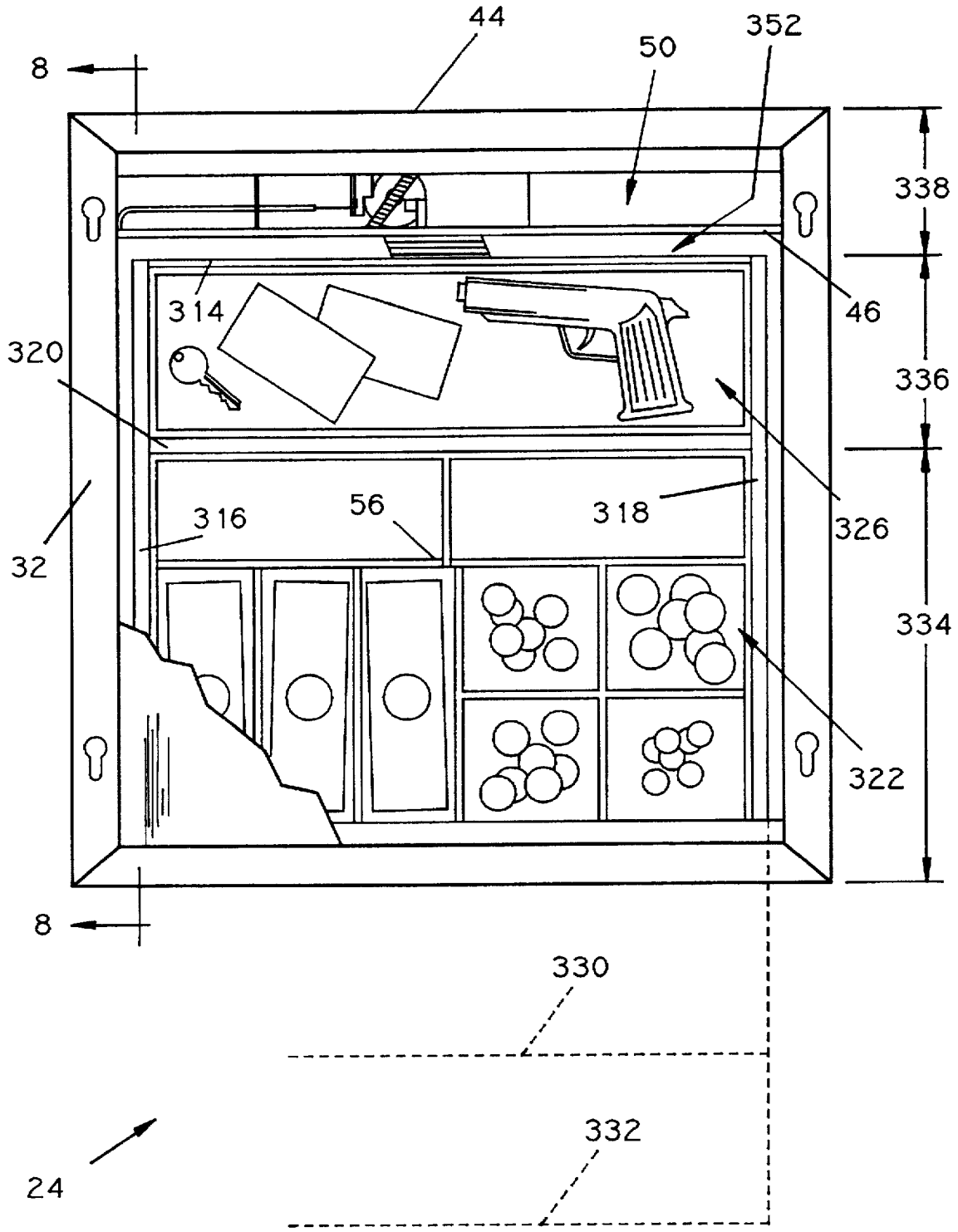
Figure 8:
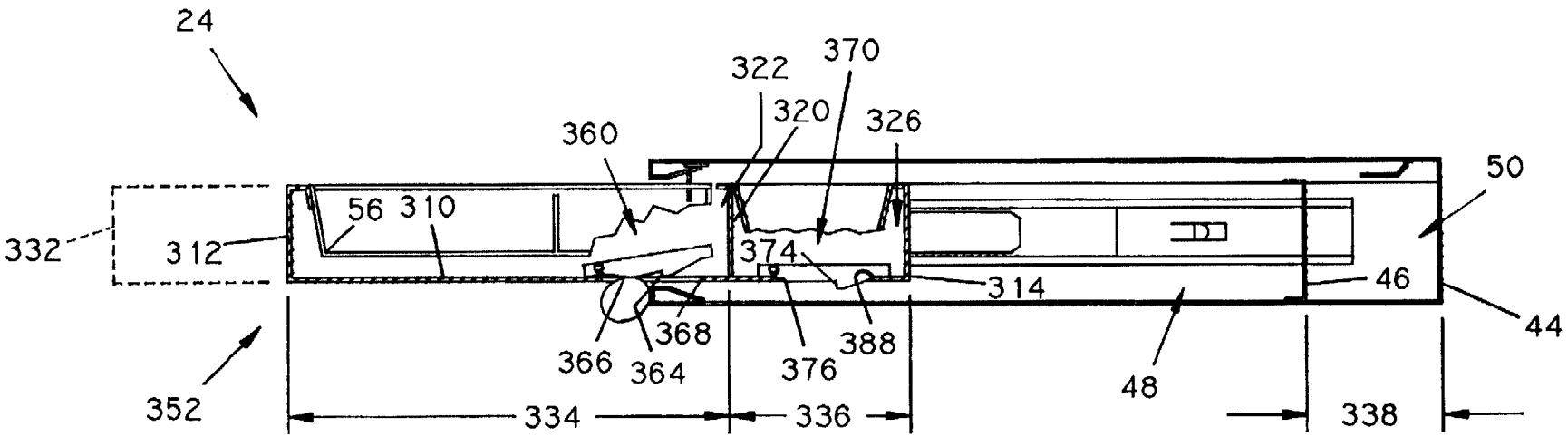
FIG. 8 is a sectional view taken along line 8—8 of FIG. 7 showing the divider received in the cash drawer engaging the money tray and spaced apart from the rear panel of the cash drawer to define the extra compartment and gravity operated first and second drawer stops pivotably coupled to the cash drawer, the first and second drawer stops being positioned along the cash drawer so that the first drawer stop cooperates with the stop on the housing to stop the forward movement of the cash drawer when the money tray is exposed, the first drawer stop being movable to the release position disengaged from the stop of the housing so that the cash drawer can be moved until the second drawer stop engages the stop on the housing to stop the forward movement of the cash drawer when the extra compartment is exposed, the second drawer stop being movable to the release position disengaged from the stop of the housing so that the cash drawer can be removed from the housing.

If desired, cash drawer assembly 24 can be configured to include an "elongated" cash drawer 352 receiving money tray 56 and having a drawer pan 310 and a front panel 312, a rear panel 314, a first side panel 316, and a second side panel 318, each of which is connected to drawer pan 310 and extends upwardly therefrom as shown in FIGS. 7 and 8 when cash drawer 352 faces upwardly. In addition, a divider 320 engages first and second side panels 316, 318 and is spaced apart from front panel 312 by a distance 334 and from rear panel 314 by a distance 336 as shown in FIG. 8 so that divider 320 cooperates with front panel 312 to define a money tray-receiving space 322 and with rear panel 314 to define an extra compartment 326 of cash drawer 352 as shown in FIGS. 7 and 8.

In preferred embodiments, drawer pan 310 and first and second side panels 316, 318 of cash drawer 352 are about four inches (10.2 cm) longer than drawer pan 58 and first and second side panels 62, 64 of cash drawer 52. Preferably distance 336 between divider 320 and rear panel 314 is about four inches (10.2 cm) so that money tray-receiving space 322 is about the same size as the space defined by cash drawer 52 and so that the additional length of drawer pan 310 and first and second side panels 316, 318 defines extra compartment 326. To fit cash drawer 352 into interior region 48 of housing 32, a distance 338 between rear wall 46 and back wall 44 of housing 32 is minimized while still providing latching assembly-receiving space 50 of sufficient size for containing latching mechanism 82 as shown in FIGS. 7 and 8.

Similar to cash drawer 52, cash drawer 352 can be provided with a gravity-operated first drawer stop 360 that cooperates with stop 162 formed on housing 32 to stop the forward movement of cash drawer 352 away from the closed position when cash drawer 52 reaches a first open position exposing money tray 56 and money tray-receiving space 322 as shown by dashed line 330 in FIGS. 7 and 8. Drawer stop 360 includes a stop tab 364 that engages stop 162 of housing 32 to stop the forward motion of cash drawer 52. Drawer stop 360 is pivotably mounted to cash drawer 352 for movement between a stop position in which stop tab 364 engages stop 162 when cash drawer is in the first open position and an upward release position moving stop tab 364 away from stop 162 so that cash drawer 352 can be pulled forwardly past the first open position. When first drawer stop 360 is in the stop position, stop tab 364 extends downwardly past drawer pan 310 of cash drawer 352 through a slot 368 so that stop tab 164 can engage stop 162 of housing 32. In preferred embodiments, cash drawer 352 is provided with two opposing drawer stops 360 on each side of cash drawer 352 that cooperate to stop the forward movement of cash drawer 352 at the first open position.

In addition, cash drawer 352 can be provided with a gravity-operated second drawer stop 370 that cooperates with stop 162 formed on housing 32 to stop the forward movement of cash drawer 352 away from the closed position when cash drawer 52 reaches a second open position exposing extra compartment 326 as shown by dashed line 332 in FIGS. 7 and 8. Drawer stop 370 includes a stop tab 374 that engages stop 162 of housing 32 to stop the forward motion of cash drawer 52. Drawer stop 370 is pivotably mounted to cash drawer 352 for movement between a stop position in which stop tab 374 engages stop 162 when cash drawer is in the second open position and an upward release position moving stop tab 374 away from stop 162 so that cash drawer 352 can be pulled forwardly past the second open position and removed from housing 32. When second drawer stop 370 is in the stop position, stop tab 374 extends downwardly past drawer pan 310 of cash drawer 352 through a slot 388 so that stop tab 164 can engage stop 162 of housing 32. In preferred embodiments, cash drawer 352 is provided with two opposing drawer stops 370 on each side of cash drawer 352 that cooperate to stop the forward movement of cash drawer 352 at the second open position.

Each drawer stop 360, 370 is formed to include a lug 366, 376 that is manually contactable to pivot drawer stop 360, 370 from the downward stop position to the upward release position when a contact force is applied thereto as shown in FIG. 8. Lug 366, 376 is exposed beneath drawer pan 310 through slot 368, 388 when drawer stop 360, 370 is in the stop position so that the clerk can manually contact lug 366, 376 to pivot drawer stop 360, 370 from the stop position to the release position.

Thus, to gain access to extra compartment 326, the clerk simply allows cash drawer to move to the first open position, grasps the sides of cash drawer 352, manually contacts lug 366 of each drawer stop 360 and applies a contact force thereto to pivot each drawer stop 360 to the release position, and then pulls cash drawer 352 forwardly to the second open position exposing extra compartment 326. To remove cash drawer 352 from housing 32, the clerk simply grasps the sides of cash drawer 352, manually contacts lug 376 of each drawer stop 370 and applies a contact force thereto to pivot each drawer stop 370 to the release position, and then pulls cash drawer 352 forwardly to remove cash drawer 352 from housing 32.

Cash drawer assembly 24 having cash drawer 352 thus operates the same and has a similar appearance to cash drawer assembly 24 having cash drawer 52 except that cash drawer assembly 24 including cash drawer 352 has the added feature that by lifting first drawer stops 360 cash drawer 352 can slide forward about four inches (10.2 cm) to second drawer stops 370 exposing extra compartment 326 located behind money tray 56. Extra compartment 326 is hidden from view during normal operation of cash drawer 352 and can be used to hold items such as media, spare currency, rolled coin, weapons, or other items that might be useful for the clerk as shown in FIG. 7.

AS described above with reference to FIG. 3, when cash drawer 52 is in the closed position, tongue 78 extends rearwardly from rear panel 60 of cash drawer 52 through tongue-receiving opening 70 formed in rear wall 46 of housing 32 to engage latching mechanism 82 of latching assembly 80. Latching assembly 80 is positioned to lie behind rear wall 46 of housing 32 and is received in latching assembly-receiving space 50 which is defined by rear wall 46, top wall 34, bottom wall 36, first side wall 38, second side wall 40, and back wall 44 of housing 32.

Latching assembly 80 includes latching mechanism 82 which is moveable between a locked position locking cash drawer 52 in the closed position and a release position allowing cash drawer 52 to move from the closed position to the open position. The movement of latching mechanism 82 is controlled by latching control assembly 84 which can be moved between a locked-closed mode locking latching mechanism 82 in the locked position, a locked-open mode locking latching mechanism 82 in the release position, and a ready-to-operate mode allowing latching mechanism 82 to move between the locked position and the release position.

Latching mechanism 82 includes tongue 78 and a catch cam 180 rotatably mounted to a mounting plate 190 that is fixed to rear wall 46 of housing 32. Catch cam 180 is moveable between a catch position shown in FIG. 9 engaging tongue 78 to hold cash drawer 52 in the closed position and a release position shown in FIG. 10 releasing tongue and allowing cash drawer to move from the closed position to the open position. An upper cam spring 182 and a lower cam spring 184 couple catch cam 180 to rear wall 46 as shown best in FIG. 12 to yieldably bias catch cam 180 in a first direction 192 toward the release position when catch cam is in the release position and to yieldably bias catch cam 180 in a second direction 194 toward the catch position when catch cam 180 is in the catch position.

Figure 9:
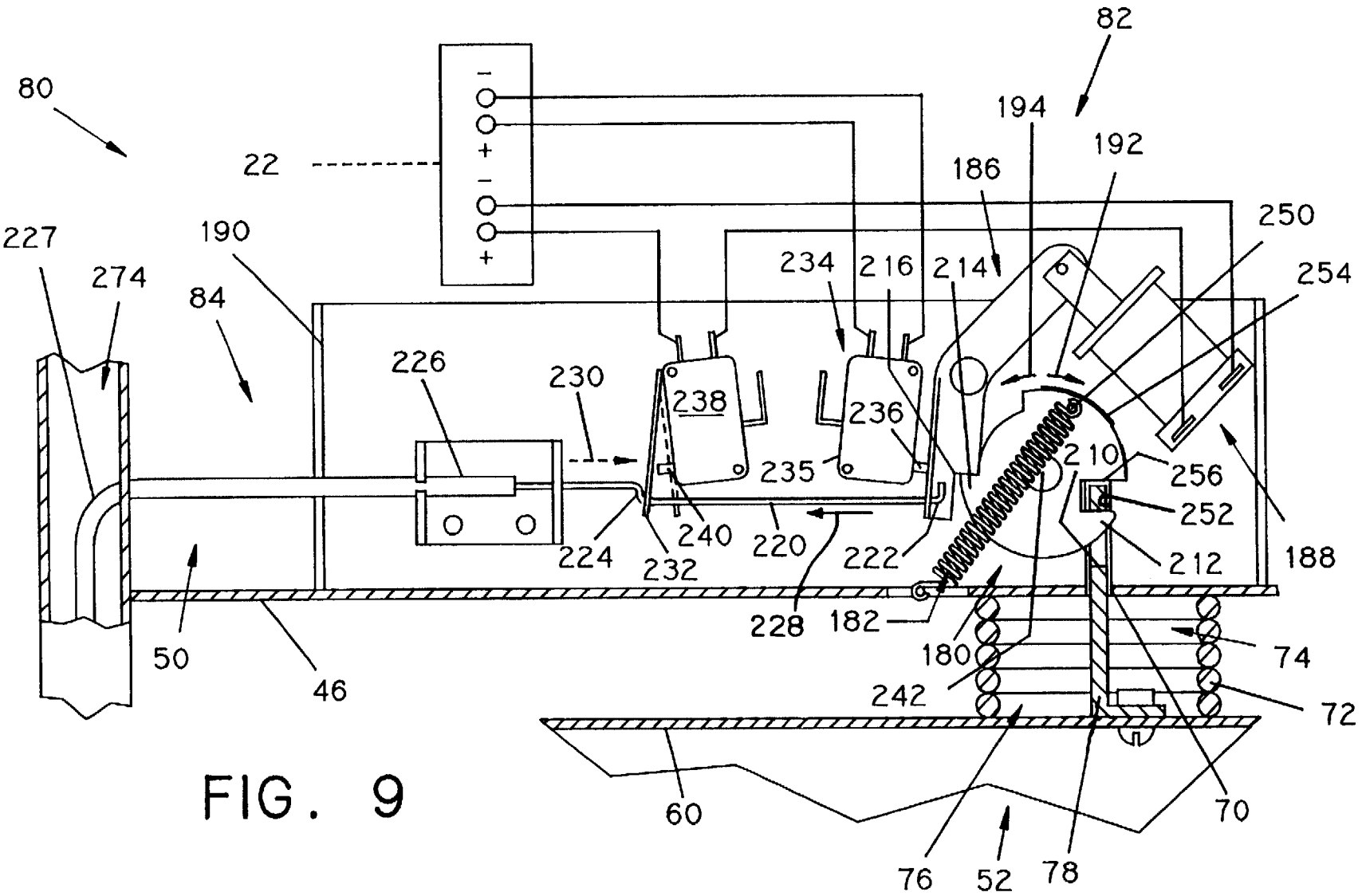
FIG. 9 is a top plan view of a latching assembly in accordance with the present invention in a "ready-to-operate mode" showing a latching mechanism and portions of a latching control assembly, the latching mechanism including the tongue attached to the rear wall of the cash drawer and extending rearwardly through the interior region of the drawer spring and through the opening in the rear wall of the housing to engage a catch on a catch cam, the catch cam including a locking tab spaced apart from the catch and engaging a pivotable latch to lock the catch cam in a catch position and holding the tongue and cash drawer in the closed position relative to the housing, the drawer spring operating through the drawer, the tongue, and the catch to yieldably bias the catch cam in a first direction toward a release position, a cam spring connected to the catch cam and connected to the housing to yieldably bias the catch cam in a second direction toward the catch position so that the force exerted on the catch cam by the cam spring opposes the force exerted on the catch cam by the drawer spring to minimize the force of the locking tab acting against the latch and thereby minimize the force required to pivot the latch from the locking position to the releasing position by a solenoid, the latch engaging a button of a latch-status switch of the latch control assembly, the latch-status switch providing an electrical latch-status signal in response to the position of the latch indicating that the latch is in the locking position, the latch control assembly further including a cable having a hook engaging the latch and a crook engaging a lever mounted to a locked-closed switch, the lever being movable by the crook to a locked-closed position (in phantom) interrupting an electrical circuit between the solenoid and the PC of the POS system to prevent the solenoid from receiving a cash drawer release signal from the PC that would otherwise cause the solenoid to pivot the latch to the release position, the locked-closed switch thereby cooperating with the PC and the solenoid to provide an electrically operated "locked-closed mode" locking the cash drawer in the closed position.

A latch 186 is pivotably mounted to mounting plate 190 for movement between a locking positions-engaging catch cam 180 to hold catch cam in the catch position as shown in FIG. 9 and a releasing position away from catch cam 180 allowing catch cam 180 to rotate in first direction 192 away from the catch position to the release position. A solenoid 188 is also mounted to mounting plate 190 and is attached to latch 186 so that when solenoid 188 receives the drawer-release signal from PC 22, solenoid 188 pivots latch 186 from the locking position to the releasing position allowing catch cam 180 to rotate in the first direction 192 toward the release position. Preferred solenoid 188 is a model number C8-2183 12 volt DC solenoid manufactured by Dormeyer Industries located in Rockville, Ind.

Tongue 78 is formed to include an opening 210 that is positioned to lie in the latching assembly-receiving space 50 when cash drawer 52 is in the closed position as shown in FIG. 9. Catch cam 180 is formed to include a catch 212 received in opening 210 of tongue 78 when latching mechanism 82 is in the locked position so that catch 212 hooks tongue 78 to retain tongue 78 and cash drawer 52 in the closed position. It can be seen that when latching mechanism is in the locked position, drawer spring 72 operates through cash drawer 52 and tongue 78 to yieldably bias catch cam 180 in first direction 192 away from the catch position and toward the release position.

Catch cam 180 is also formed to include a locking tab 214 as shown in FIG. 9. Latch 186 is formed to include a locking edge 216 engaging locking tab 214 of catch cam 180 when latching mechanism 82 is in the locked position to block rotation of catch cam 180 in first direction 192 toward the release position. So long as locking edge 216 engages locking tab 214, rotation of catch cam 180 in first direction 192 will be blocked and latching mechanism 82 will remain in the locked position having catch 212 received in opening 210 of tongue 78 and preventing movement of cash drawer 52 away from the closed position.

Figure 10:
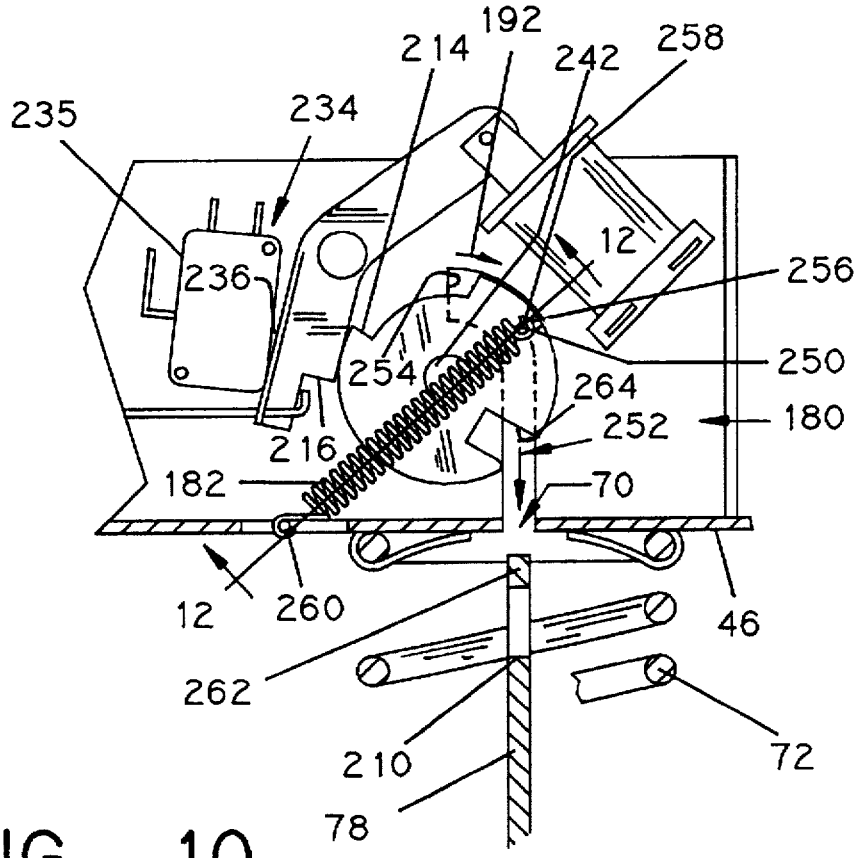
FIG. 10 is a top plan view of the latching mechanism and the latch-status switch of FIG. 9 in the ready-to-operate mode showing the solenoid activated and pivoting the latch to the releasing position so that the latch disengages from the locking tab of the catch cam allowing the catch cam to rotate in the first direction from the catch position to the release position, the tongue being yieldably biased away from the catch cam by the drawer spring and disengaging from the catch, the latch depressing a button on the latch-status switch so that a latch-status signal from the latch-status switch indicates that the latch is in the releasing position.

When solenoid 188 pivots latch 186 away from the locking position shown in FIG. 9 to the releasing position shown in FIG. 10, locking edge 216 disengages from locking tab 214 so that the force exerted by drawer spring 72 yieldably biasing cash drawer 52 and tongue 78 away from rear wall 46 of housing pulls tongue 78 and catch 212 forwardly, rotating catch cam 180 in first direction 192 toward the release position, releasing tongue 78 from catch 212, and allowing cash drawer 52 to move away from the closed position to the open position.

It will be understood by those skilled in the art that the force exerted by drawer spring 72 when cash drawer 52 is in the closed position and latching mechanism 82 is in the locked position will operate through cash drawer 52, tongue 78, and catch 212 to yieldably bias catch cam 180 in first direction 192 toward the release position so that drawer spring 72 yieldably biases locking tab 214 against locking edge 216 of latch 186. Thus, to pivot latch 186 from the locking position to the releasing position requires overcoming the force exerted against locking edge 216 through locking tab 214 by drawer spring 72.

Latching mechanism 82 also includes upper and lower cam springs 182, 184 that yieldably bias catch cam 180 in the second direction 194 toward the catch position when catch cam 180 is in the catch position as shown in FIG. 9. By yieldably biasing catch cam 180 toward the catch position, upper and lower cam springs 182, 184 oppose, at least in part, the force exerted on catch cam 180 by drawer spring 72. Thus, the force exerted on locking edge 216 of latch 186 by locking tab 214 of catch cam 180 is reduced by upper and lower cam springs 182, 184.

The force exerted on catch cam 180 by drawer spring 72 must be overcome by solenoid 188 to pivot latch 186 away from the locking position and to the releasing position. Thus, solenoid 188 must overcome the torque applied to catch cam 180 by drawer spring 72 less the torque applied to catch cam 180 by upper and lower cam springs 182, 184. Upper and lower cam springs 182, 184, therefore, offset the force exerted on locking edge 216 by locking tab 214 and allows for the use of a smaller, and less expensive solenoid 188 than would otherwise be required to overcome the force exerted by locking tab 214 on locking edge 216 when solenoid 188 pivots latch 186 from the locking position to the releasing position. Use of a smaller solenoid 188 reduces the cost of cash drawer assembly 24 and reduces the electrical current required to operate solenoid 188, thereby reducing the risk of cross communication between the cables providing power to solenoid 188 and PC 22.

Latching control assembly 84 interfaces with latching mechanism 82 as shown in FIG. 9 to control the operation of latching mechanism 82. Latch 186 is formed to include an upstanding wall 218 extending away from mounting plate 190. Upstanding wall 218 is formed to include an opening (not shown) that slidably receives a flexible cable 220 of latching control assembly 84. Cable 220 is formed to include a hook 222 adjacent to latch 186. Cable 220 extends from hook 222 through the opening in upstanding wall 218, through an opening (not shown) formed in a lever arm 228, to a crook 224 formed in cable 220, and into a sleeve 226 having an end mounted to mounting plate 190.

Figure 11:
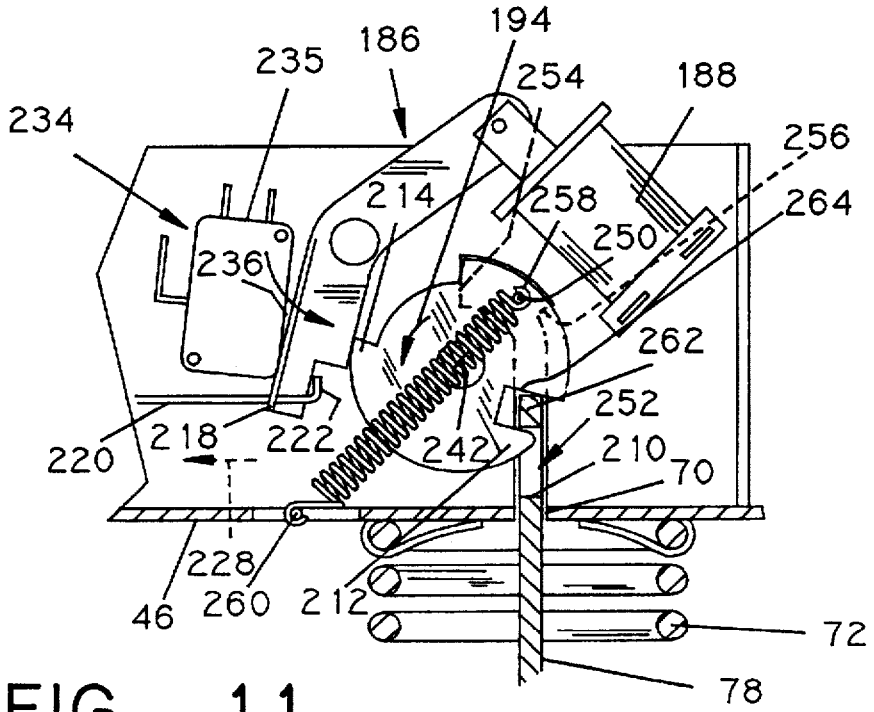
FIG. 11 is a view similar to FIG. 10 showing the catch cam in an intermediate position between the release position and the catch position as the cash drawer moves toward the closed position and the tongue engages the catch cam rotating the catch cam from the release position toward the catch position, the latch pivoting from the releasing position to the locking position under the force of a spring (not shown) of the latch-status switch, the hook of the cable being movable to a locked-open position (in phantom) holding the latch in the releasing position thereby providing a "locked-open mode" preventing the latch from engaging the locking tab so that the catch cam is not held in the catch position but instead is automatically rotated back to the release position by the drawer spring acting through the drawer, the tongue, and the catch allowing the cash drawer to automatically move back to the open position, thereby "locking" the cash drawer in the open position.

Cable 220 can be positioned in a "ready-to-operate position" shown in FIG. 9 in which latching mechanism 82 can lock cash drawer 52 in the closed position and solenoid 188 can pivot latch 186 to the releasing position in response to the drawer-release signal at appropriate steps in a transaction. Cable 220 can also be moved transversely in direction 228 to a "locked-open position" as shown in FIG. 11 in which hook 222 (in phantom) engages upstanding wall 218 of latch 186 to pivot and mechanically hold latch 186 in the releasing position so that locking edge 216 of latch 186 cannot engage locking tab 214 of catch cam 180, thereby locking latching mechanism 82 in the open position. In addition, cable 222 can be moved in direction 230 to a "locked-closed position" as shown in FIG. 9 (in phantom) in which crook 224 pivots lever arm 232 from an outward circuit-closing position to an inward circuit-opening position (in phantom) so that the drawer-release signal cannot be received by solenoid 188, thereby locking latching mechanism 82 in the closed position as described below.

Latching control assembly 84 includes a latch-status switch 234 mounted to the mounting plate 190, coupled to PC 22, and including a shell 235 receiving a button 236 engaging upstanding wall 218 of latch 186 as shown in FIG. 9. Latching control assembly 84 also includes a locked-closed switch 238 mounted to mounting plate 190, coupled to PC 22 and solenoid 188, and including a button 240. Lever arm 232 is pivotably coupled to locked-closed switch 238 and engages button 240. Latch-status switch 234 is preferably a switch model number E33-00AX manufactured by Cherry Electrical Products located in Waukegan, Illinois and locked-closed switch 236 is preferably a switch model number E33-50HX manufactured by Cherry Electrical Products located in Waukegan, Ill.

Latch-status switch 234 provides a latch-status signal to PC 22 in response to the position of button 236 relative to shell 235 so that the latch-status signal indicates the position of latch 186 as shown in FIG. 9. Upstanding wall 218 of latch 186 engages button 236 so that when latch 186 is in the locking position, button 236 is extended from shell 235 of latch-status switch 234 and the latch-status signal indicates that latch 186 is in the locking position. When latch 186 pivots to the releasing position, latch 186 presses button 236 and retracts button 236 into shell 235 so that the latch-status signal indicates that latch 186 is in the releasing position. Thus, the position of latch 186 can be electronically monitored by PC 22 so that a clerk or other person responsible for monitoring the status of cash drawer 52 can determine the condition of latch 186 without visually observing latch 186. Button 236 is spring-loaded and the spring (not shown) of spring-loaded button 236 operates not only to extend button 236 from shell 235 so that latch-status switch 234 provides the latch-status signal to PC 22, but also to yieldably bias latch 186 to the locking position so that this "switch-operated latch reset" mechanism moves latch 186 to the locking position when catch cam 180 moves to the catch position.

Locked-closed switch 238 is positioned in series in the circuit that provides the drawer-release signal from PC 22 to solenoid 188 as shown in FIG. 9. When cable 220 is in the ready-to-operate position, crook 224 allows lever arm 232 to pivot to the circuit-closing position away from locked-closed switch 238. When lever arm 232 is in the circuit-closing position, button 240 extends outwardly from locked-closed switch 238 closing locked-closed switch 238 so that the drawer-released signal can travel from PC 22 through locked-closed switch 238 to solenoid 188. When cable 220 moves in direction 230 to the locked-closed position, crook 224 pivots lever arm 232 to the circuit-opening position depressing button 240 of locked-closed switch 238. When button 240 is depressed, locked-closed switch 238 opens the electrical circuit connecting PC 22 and solenoid 188 so that the transmission of the drawer-release signal from PC 22 to solenoid 188 is interrupted by locked-closed switch 238.

Thus, latching assembly 80 and cash drawer assembly 20 can be moved from the ready-to-operate mode to the locked-closed mode by moving cable 220 to the locked-closed position to interrupt the transmission of the drawer-release signal from PC 22 to solenoid 188 so that solenoid 188 will not receive the drawer-release signal and will not pivot latch 186 from the locking position to the releasing position. While conventional cash drawer assemblies typically include a mechanically operated locked-closed feature that mechanically locks the cash drawer to the housing when the cash drawer is closed, mechanically locking the drawer without disabling the electronics can result in chatter and overheating of the solenoid since the solenoid receives an electrical signal but cannot respond because of the mechanism is mechanically locked in the closed position. The electrically operated locked-closed feature of cash drawer assembly 24 in accordance with the present invention does not suffer from this condition, thereby minimizing the wear of solenoid 188 and maximizing the reliability of cash drawer assembly 24.

Figure 12:
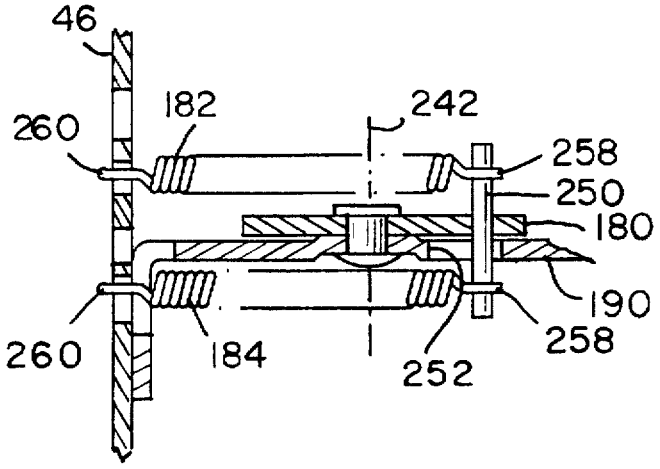
FIG. 12 is a sectional view taken along line 12—12 of FIG. 10 showing the catch cam rotatably mounted to the housing by a pin, a post attached to the catch cam and spaced-apart from the pin, and spaced-apart first and second cam springs yieldably biasing the post toward the housing, the first cam spring being positioned to lie above the catch cam and the second cam spring being positioned to lie beneath the catch cam so that the force exerted on the catch cam by the first cam spring out of the plane the catch cam is generally opposed and cancelled by the force exerted by the second cam spring out of the plane of the catch cam and the force exerted on the catch cam by the second cam spring out of the plane of the catch cam is generally opposed and cancelled by the force exerted by the first cam spring out of the plane of the catch cam.

A post 250 is connected to catch cam 180 as shown in FIGS. 9–12 and extends generally vertically therethrough as shown best in FIG. 12. Mounting plate 190 is formed to include a slot 252 extending rearwardly from rear wall 46 to receive tongue 78 as shown in FIGS. 9–11 and extending arcuately to receive post 250 so that catch cam 180 can freely rotate between the catch position and the release position. Slot 252 is formed to include a first stop 256 engaging post 250 to stop rotation of catch cam 180 in first direction 192 when catch cam 180 is in the release position as shown in FIG. 10 and a second stop 254 engaging post 250 to stop the rotation of catch cam 180 in second direction 194 when catch cam 180 is in the catch position as shown in FIG. 9.

Each of upper and lower cam springs 182, 184 include a first end 258 connected to post 250 and a second end 260 connected to rear wall 46 of housing 32 as shown best in FIG. 12. Each of upper and lower cam springs 182, 184 are tension springs and are mounted in tension so that first ends 258 are yieldably biased toward second ends 260. Upper cam spring 182 is spaced apart from lower cam spring 184 and catch cam 180 is positioned to lie therebetween. Upper and lower cam springs 182,184 are generally identical in that both springs 182, 184 are the same length when relaxed and both have the same spring constant so that any forces exerted by upper cam spring 182 on catch cam 180 out of the plane of rotation of catch cam 180 are generally cancelled by lower cam spring 184 and any forces exerted on catch cam 180 by lower cam spring 184 that are out of the plane of rotation of catch cam 180 are generally cancelled by upper cam spring 182. Minimizing such forces operating on catch cam 180 outside of the plane of rotation of catch cam 180 minimizes the stress on catch cam 180, minimizes the wear of catch cam 180 and locking mechanism 82, and thus maximizes the reliability of cash drawer assembly 24.

Catch cam 180 rotates about an axis of rotation 242 between the catch position, as shown in FIG. 9, and the release position, as shown in FIG. 10. When catch cam 180 is in the catch position, upper and lower cam springs 182, 184 yieldably bias catch cam 180 in second direction 194 toward the catch position. During rotation of catch cam 180 about axis of rotation 242 in first direction 192 away from the catch position and toward the release position second ends 260 of cam springs 182, 184 remain fixed to rear wall 46 and first ends 258 move with catch cam 180 and post 250 so that upper and lower cam springs 182, 184 pass through axis of rotation 242. As a result, upper and lower cam springs 182, 184 also yieldably bias catch cam 180 in first direction 192 toward the release position when catch cam 180 is in the release position as shown in FIG. 10.

As described above, drawer spring 72 acts through cash drawer 52, tongue 78, and catch 212 to yieldably bias catch cam 180 in first direction 192 toward the release position when latching mechanism is in the locked position as shown in FIG. 9 forcing locking tab 214 of catch cam 180 against locking edge 216 of latch 186. Upper and lower cam springs 182, 184 yieldably bias catch cam 180 in second direction 194 when latching mechanism 82 is in the locked position to offset at least a portion of the force exerted by drawer spring 72. By positioning post 250 on catch cam 180 so that upper and lower cam springs 182, 184 pass through axis of rotation 242 of catch cam 180 during the rotation of catch cam 180 between the catch position and the release position, upper and lower cam springs 182, 184 operate both to yieldably bias catch cam 180 in first direction 192 toward the release position when catch cam 180 is in the release position ensuring that catch cam 180 will remain in the release position until acted upon by tongue 78 and to yieldably bias catch cam 180 in second direction 194 toward the catch position when catch cam 180 is in the catch position minimizing the pressure exerted between locking tab 214 and latch 186 so that latch 186 can be more easily pivoted from the locking position to the releasing position.

Minimizing the pressure between locking tab 214 and latch 186 minimizes the wear of latch 186, catch cam 180, and solenoid 188, thus maximizing the reliability of cash drawer assembly 24. Minimizing the pressure between locking tab 214 and latch 186 also allows for minimizing the size of solenoid 188 and the electrical current required to activate solenoid 188, minimizing the cost of solenoid 188 and minimizing the risk of electrical interference between the cables carrying the current to solenoid 188 and other cables of PC 22 and cash drawer assembly 24.

As described above, when latching mechanism 82 is in the locked position, catch 212 is received by opening 210 of tongue 78 as shown in FIG. 9. When latch 186 pivots from the locking position to the releasing position releasing catch cam 180, drawer spring 72 pushes cash drawer 52 forwardly away from rear wall 46 so that tongue 78 is withdrawn from slot 252 pulling catch 212 forwardly and thereby rotating catch cam 180 in direction 192 toward the release position as shown in FIG. 10. As described above, once catch cam 180 is in the release position, upper and lower cam springs 182, 184 will retain catch cam 180 at the release position.

When the clerk moves cash drawer 52 from the open position to the closed position, tongue 78 moves rearwardly through tongue-receiving opening 70 of rear wall 46 and into slot 252 of mounting plate 190 as shown in FIG. 11. A tip 262 of tongue 78 engages an edge 264 of catch cam 180 and continued rearward movement of tongue 78 rotates catch cam 180 from the release position in second direction 194 toward the catch position.

If upper and lower cam springs 182, 184 were not configured to yieldably bias catch cam 180 in first direction 192 toward the release position when catch cam 180 is in the release position, it would be possible for catch cam 180 to rotate away from the release position when tongue 78 is away from slot 252. If catch cam 180 were away from the release position when tongue 78 enters tongue-receiving opening 70 and slot 252 as cash drawer 52 moves toward the closed position, tip 262 of tongue 78 would strike catch cam 180 away from edge 264 of catch cam 180 and, instead of being hooked by catch 212, tongue 78 would instead bounce away from catch cam 180 and move back toward the open position. While it may be advantageous to lock cash drawer assembly 24 so that cash drawer 52 cannot be closed, having tongue 78 strike cash cam 180 in such a manner would adversely effect the wear characteristics of cash drawer assembly 24.

Latching control assembly 84 can be configured in a ready-to-operate mode, a locked-open mode and a locked-closed mode. In the ready-to-operate mode latching control assembly 84 allows latching mechanism 82 to move between the locked and release positions in accordance with the position of cash drawer 52 and in accordance with the drawer-release signal provided to solenoid 188 from PC 22 in response to user inputs to PC 22. In the locked-closed mode latching control assembly 84 prevents solenoid 188 from receiving the drawer-release signal so that latching mechanism 82 does not move away from the locked position. The locked-closed mode is particularly useful when a manager or other employee responsible for the contents of cash drawer 52 and money tray 56 wish to restrict access to cash drawer 52 and money tray 56. When in the locked-open mode latching control assembly 84 prevents latching mechanism 82 from moving away from the release position.

Latching control assembly 84 is moved to the locked-open mode when cable 220 moves in direction 228 to the locked-open position as shown in FIG. 11. When cable 220 is in the locked-open position, hook 222 engages upstanding wall 218 of latch 186 and mechanically draws latch 186 from the locking position to the releasing position and overcomes the force of the spring of latch-status switch 234 and holds latch 186 in the releasing position. When latch 186 is held in the releasing position by hook 222, locking edge 216 of latch 186 cannot engage locking tab 214 of catch cam 180. When the clerk closes cash drawer 52, tip 262 of tongue 78 engages edge 264 of catch cam 180 and rotates catch cam 180 in direction 194 to the catch position. However, latch 186 remains in the releasing position and locking edge 216 of latch 186 is held away from locking tab 214 of catch cam 180. As a result, drawer spring 72 yieldably biases cash drawer 52 away from rear wall 46 and causes cash drawer 52 to automatically move back from the closed position to the open position. A clerk may choose to place latching control assembly 84 in the locked-open mode when POS system 20 is not in use and money tray 56 is empty so that burglars or other unauthorized personnel in the vicinity of cash drawer 20 will not damage cash drawer assembly 24 in an attempt to force cash drawer 52 from the closed position to the open position.

Figure 13:
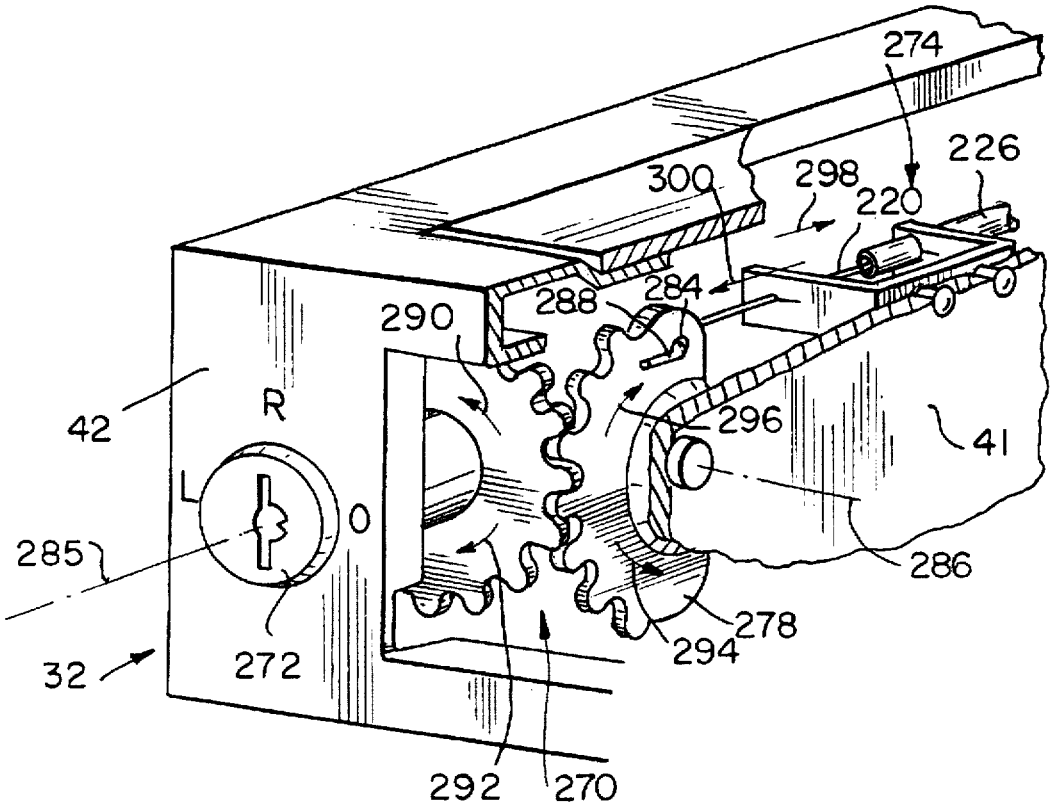
FIG. 13 is a perspective view of the housing with portions broken away showing a portion of the latch control assembly for manipulating the position of the cable including a key lock mechanism having a core, a first gear connected to the core, and a second gear positioned to lie in orthogonal relation to the first gear and rotatably coupled to the housing, the cable being connected to the second gear so that rotating a key in the key lock mechanism rotates the core and the first gear which rotates the second gear to extend and retract the cable between the locked-open position, the ready-to-operate position, and the locked-closed position.

Cable 220 is moved between the locked-open position of FIG. 11 and the locked-closed position of FIG. 9 (in phantom) in response to user inputs provided through a key lock mechanism 270 as shown in FIG. 13. As can be seen in FIGS. 1, 2, 9, and 13, key lock mechanism 270 includes a core 272 mounted in front wall 42 of housing 32. Key lock mechanism 270 is preferably a 3-position key lock model number 3186 made by the Chicago Lock Company located in Chicago, Ill. Cable 220 and sleeve 226 extend rearwardly from key lock mechanism 270 in a channel 274 defined by second side wall 40 and slide mounting surface 41 of housing 32 and emerges therefrom in the latching assembly-receiving space 50 as shown in FIG. 9. Cable 220 is flexible and capable of bending around a corner 227 defined by sleeve 226 as shown in FIG. 9 without permanently assuming the shape of sleeve 226.

Key lock mechanism 270 includes a first gear 276 mounted to core 272 for rotation relative to housing 32 about an axis of rotation 285 defined by core 272 and a second gear 278 mounted to second side wall 40 for rotation relative to housing 32 about an axis of rotation 286 which is in orthogonal relation to axis rotation 285 of first gear 276. Teeth 280 of first gear 276 are enmeshed with teeth 282 of second gear 278 so that rotation of core 272 and first gear 276 about axis 285 causes rotation of second gear 278 about axis 286.

Second gear 278 is formed to include an opening 284 spaced apart from axis of rotation 286 of second gear 278 as shown in FIG. 13. Cable 220 is formed to include a second hook 288 received in opening 284 of second gear 278 so that as second gear 278 rotates about axis of rotation 286, cable 220 extends into sleeve 226 and retracts from sleeve 226. For example, when a key (not shown) is inserted into key lock mechanism 270 and is rotated counterclockwise by a user in direction 290, first gear 276 will rotate in direction 290 causing second gear 278 to rotate in clockwise direction 296 pushing cable 220 in direction 298 as shown in FIG. 13 so that cable 220 in latching assembly-receiving space 50 will move in direction 230 to the locked-closed position. For another example, when the key in core 272 is rotated in clockwise direction 272, first gear 276 will rotate in direction 292 causing second gear 278 to rotate in counterclockwise direction 294 pulling cable 220 in direction 300 so that cable 220 in latching assembly-receiving space 50 will move in direction 228 as shown in FIG. 11 to the locked-open position. Thus, the position of cable 220 and the mode of latching assembly 80 is controlled by the operation of key lock mechanism 270.

Figure 14:
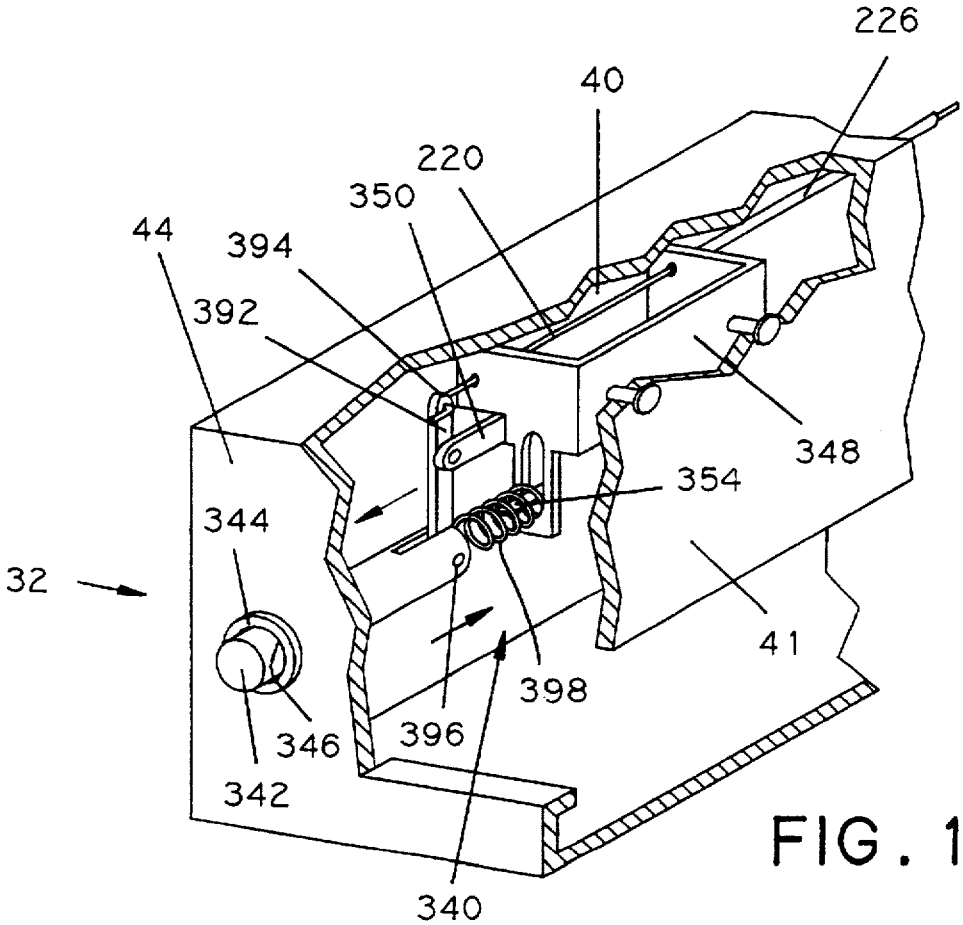
FIG. 14 is a perspective view of the housing with portions broken away showing a portion of a second embodiment of a latch control assembly for manipulating the position of the cable including a push-button assembly having a bell crank having a pivot point that is fixed relative to the housing, a button axially movable to pivot the bell crank, the cable being connected to the bell crank so that pressing the button pivots the bell crank and pulls the cable forward so that the cable manually moves the latch (not shown) from the locking position to the releasing position, and a compression spring coupled to the button and to the housing to yieldably bias the button from an inward pressed position toward an outward extended position.

If desired, cash drawer assembly 24 can include a "push-button" lock mechanism 340 as shown in FIG. 14 instead of key lock mechanism 270. Preferably, lock mechanism 340 is used to manipulate a "manual" latching mechanism 378 shown in FIG. 15 so that cash drawer assembly 24 having lock mechanism 340 and latching mechanism 378 is a "manual" cash drawer.

Lock mechanism 340 includes a button housing 344 preferably mounted to front wall 42 of housing 32, button housing 344 including an opening 346 slidably receiving a button 342 for movement relative to button housing 344 between an inward pressed position and an outward extended position as shown in FIG. 14. A bracket 348 is mounted to second side wall 40 adjacent to slide mounting surface 41 and is formed to include a frontwardly-extending arm 350 and a frontwardly-extending tongue 354. A bell crank 392 having a first end (not shown) and a second end 394 generally positioned to lie above the first end is pivotably coupled to arm 350 at a point spaced apart from each of the first end and second end 394. The first end of bell crank 392 is pivotably coupled to button 342 by a pivot pin 396 and second end 394 is coupled to cable 220. Moving button 342 to the pressed position by pressing button 342 causes bell crank 392 to pivot by pushing the first end rearwardly and second end 394 forwardly pulling cable 220 forwardly and causing cable 220 in latching assembly-receiving space 50 to move in direction 228 as shown in FIG. 15.

A compression spring 398 is coupled to tongue 354 and to button 342 to yieldably bias button 342 forwardly away from bracket 348 as shown in FIG. 14. When the clerk releases button 342, spring 398 automatically moves button 342 back to the extended position pulling the first end of bell crank 342 forwardly and pivoting bell crank 342 to move second end 394 of bell crank 342 and cable 220 rearwardly causing cable 220 in latching assembly-receiving space 50 to move in direction 230 as shown in FIG. 15. Thus, rather than using key lock mechanism 270 to positing cable 220, push-button lock mechanism 340 can be used to position cable 220.

Figure 15:
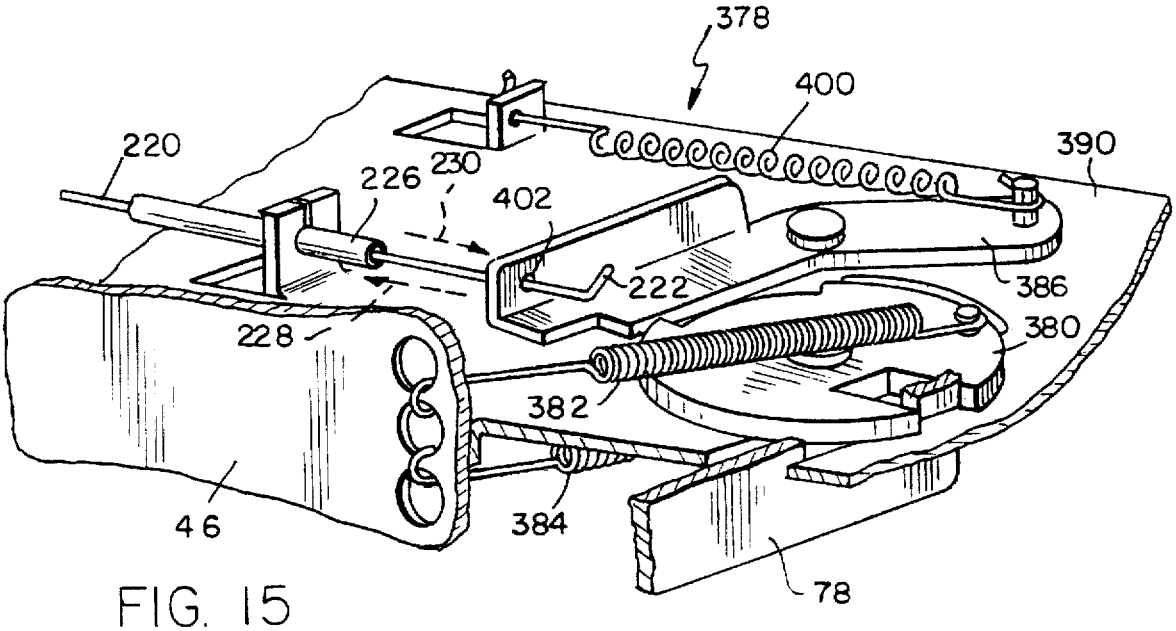
FIG. 15 is a perspective view of a mounting plate and a second embodiment of the latching mechanism mounted to the mounting plate for manually operating the cash drawer showing the cable extending from the button (not shown), through a sleeve, and through an opening formed in the latch, the cable having the hook that is movable relative to the latch, the cable retracting into the sleeve when the button is pressed so that the hook engages the latch and moves the latch from the locking position to the releasing position allowing the cash drawer to automatically move away from the closed position when the button is pressed, and a spring coupled to the latch and coupled to the mounting plate to yieldably bias the latch away from the releasing position and toward the locking position so that the latching mechanism automatically locks the drawer in the closed position when the drawer is moved to the closed position and the button is released.

Cash drawer assembly 24 can also be provided with latching mechanism 378 mounted to mounting plate 390 as shown in FIG. 15. Latching mechanism 378 is similar to latching mechanism 82 in that latching mechanism 378 is movable between a locked position locking cash drawer 52 in the closed position relative to housing 32 preventing movement of cash drawer 52 relative to housing 32 and a release position allowing cash drawer 52 to slide relative to housing 32.

Latching mechanism 378 includes tongue 78 and a catch cam 380 rotatably mounted to mounting plate 390 that is fixed to rear wall 46 of housing 32 as shown in FIG. 15. Catch cam 380 is moveable between a catch position shown in FIG. 15 engaging tongue 78 to hold cash drawer 52 in the closed position and a release position releasing tongue and allowing cash drawer to move from the closed position to the open position. An upper cam spring 382 and a lower cam spring 384 couple catch cam 380 to rear wall 46 to yieldably bias catch cam 380 toward the release position when catch cam is in the release position and to yieldably bias catch cam 380 toward the catch position when catch cam 380 is in the catch position.

A latch 386 is pivotably mounted to mounting plate 390 for movement between a locking position engaging catch cam 380 to hold catch cam in the catch position and a releasing position away from catch cam 380 allowing catch cam 380 to rotate away from the catch position toward the release position as shown in FIG. 15. A tension spring 400 is coupled to latch 386 and to mounting plate 390 to yieldably bias latch 386 away from the releasing position and toward the locking position.

Latch 386 is formed to include an opening 402 receiving cable 220 as shown in FIG. 15. Opening 402 is sized so that cable 220 can easily slide within opening 402 relative to latch 386. When cash drawer 52 is in the closed position and latch 386 is in the locking position, rotation of catch cam 380 in the releasing direction is blocked, thereby preventing movement of cash drawer 52 away from the closed position and locking cash drawer 52 relative to housing 32.

When cable 220 is moved in direction 228 and retracted into sleeve 226, hook 222 engages latch 386 moving latch 386 from the locking position to the releasing position away from catch cam 380 and allowing rotation of catch cam 380 relative to mounting plate 390 so that the force exerted by drawer spring 72 yieldably biasing cash drawer 52 and tongue 78 away from rear wall 46 of housing pulls tongue 78 forwardly, rotating catch cam 380 toward the release position, releasing tongue 78 from catch cam 380, and allowing cash drawer 52 to move away from the closed position toward the open position. When cable 220 is moved in direction 230 to extend from sleeve 226, hook 222 disengages from latch 386 so that spring 402 automatically moves latch 386 from the releasing position to the locking position. Subsequent movement of cash drawer 52 from the open position to the closed position causes tongue 78 to rotate catch cam 380 to the catch position as described above with reference to FIGS. 9–12 for catch cam 180. Spring 402 yieldably biases latch 386 to the locking position so that once catch cam 380 reaches the catch position, latch 386 cooperates with catch cam 380 and tongue 78 to lock cash drawer 52 relative to housing 32.

As described above, cash drawer assembly 24 can include push-button lock mechanism 340 and manual latching mechanism 378 shown in FIG. 15 so that cash drawer assembly 24 having lock mechanism 340 and latching mechanism 378 is a "manual" cash drawer. When using a manual cash drawer, the clerk will process the transaction in the same manner as for other cash drawers. However, instead of having a device providing an electrical signal causing cash drawer 52 to automatically open, when the clerk using the manual cash drawer requires access to money tray 56, the clerk simply presses button 342 moving button 342 to the depressed position and causing cash drawer 52 to automatically open exposing money tray 56. Once the clerk releases button 342 allowing button to move back to the extended position, the clerk can move cash drawer 52 from the open position to the closed position and cash drawer 52 will automatically lock in the closed position.

Pressing button 342 causes bell crank 392 to pivot pulling cable 220 connected to bell crank 392 forwardly as shown in FIG. 14 and moving cable 220 coupled to latch 386 in direction 228 into sleeve 226 as shown in FIG. 15. Hook 222 engages latch 386 moving latch 386 from the locking position to the releasing position allowing catch cam 380 to rotate, releasing tongue 78 from catch cam 380, and allowing drawer spring 72 to automatically move cash drawer 52 away from the closed position. When the clerk releases button 342, spring 398 moves button 342 from the depressed position to the extended position pivoting bell crank 392 so that cable 220 is pushed rearwardly into sleeve 226 as shown in FIG. 14. Cable 220 coupled to latch 386 moves in direction 230 extending from sleeve 226 allowing spring 400 to automatically move latch 386 toward the locking position. When cash drawer 52 moves to the closed position and tongue 78 rotates catch cam 380 to the catch position, latch 386 once again engages catch cam 380 to block the rotation of catch cam 380 and lock cash drawer 52 in the closed position. Thus, if desired, cash drawer assembly 24 can be provided in a "manual" configuration allowing cash drawer assembly 24 to operate without the use of electronic controls or signals.

Cash drawer assembly 24 in accordance with the present invention is assembled using center-line spring and tongue mounting having drawer spring 72 and tongue 78 positioned to lie generally mid-way between first and second side walls 38, 40 of housing 32 so that torque applied to cash drawer 52 by drawer spring 72, particularly when cash drawer 52 is held in the closed position by tongue 78, is minimized, thereby minimizing the wear of drawer slides 66 connecting cash drawer 52 to housing 32 and thereby maximizing the reliability of cash drawer assembly 24. In addition, cash drawer assembly 24 is constructed using symmetrical construction designs so that housing 32 is an invertible housing that can be mounted either to a top surface 28 of counter 26 or a bottom surface 30 of counter 26.

Housing 32 is constructed using a wrap-around construction design so that housing 32 can be made from a unitary piece minimizing tolerance variations found in conventional housings and providing mounting surfaces for drawer slides 66 without having to install additional mounting brackets. The wrap-around construction design allows for the provision of spacer bars 86 in the unitary piece from which housing 32 is constructed. Spacer bars 86 can be precisely formed so that the dimensions of spacer bars 86, and thus of housing 32, can be repeated with very small variations from housing to housing.

Housing 32 can also be formed to include a tray anti-catch tab 156 that prevents money tray 56 from catching on the inside of front opening 96 of housing 32, particularly when media is stuffed in supplemental storage space 154 beneath money tray 56 lifting money tray 56 away from cash drawer 52. Cash drawer 52 can also be provided with gravity operating drawer stops that stop the forward movement of cash drawer 52 relative to housing 32 when cash drawer 52 is in the open position. Gravity operated drawer stops 160 are moved by gravity to a downward stop position at which stop tabs 164 formed on drawer stops 160 engage stops 162 formed on housing 32 to block additional forward movement of cash drawer 52 when cash drawer 52 is in the closed position. When the clerk wishes to remove cash drawer 52 from housing 32, the clerk simply applies a contact force to lugs 166 on drawer stops 160 pivoting drawer stops 160 from the stop position to the release position and then pulls cash drawer 52 forward and out of housing 32.

Cash drawer assembly 24 also includes latching assembly 80 having latching mechanism 82 which is controlled by latching control assembly 84. Latching assembly 80 can be moved to an electrically operated locked-closed mode which eliminates chatter and overheating of electrical components that can occur in conventional mechanically locked locked-closed systems when the electrical components receive an electrical signal to release the drawer but are mechanically prevented from doing so. Latching assembly 80 additionally includes a mechanical locked-open mode that prevents cash drawer 52 from being locked in the closed position.

Latching control assembly 84 is operated using a right angle gear/flexible cable release mechanism including key lock mechanism 270 having first and second gears 276, 278 in orthogonal relation, the gears operating to extend and retract the flexible cable 220 so that cable 220 can extend and retract in directions 298, 300 as shown in FIG. 13 and at the same time can move in directions 228, 230 which are perpendicular to directions 298, 300 to control latching control assembly 84 as shown in FIGS. 9 and 11. Use of the right angle gears and flexible cable release mechanism minimizes the number of parts and particularly the number of moving parts required to operate latching control assembly 84. In addition, cable 220 is simple and reliable and allows for an overall design which is simple and reliable.

Latching mechanism 82 is a "load compensating latch" including catch cam 180 which is biased by drawer spring 72 in direction 192 toward the catch position when cash drawer 52 is locked in the closed position. Latching mechanism 82 also includes upper and lower cam springs 182, 184 which compensate, at least in part, for the load applied to catch cam 180 by drawer spring 72 through cash drawer 52, tongue 78, and catch 212 of catch cam 180. Use of the load compensating latch in cash drawer assembly 24 allows for the use of a smaller solenoid 188 to pivot latch 186. The smaller solenoid 188 is less expensive than a larger solenoid would be and draws a lower current than would be drawn by a larger solenoid resulting in fewer "stray" currents that could effect adjacent electronics in PC 22. In addition, use of the load compensating latch minimizes the wear of latching assembly 80, maximizing the reliability of latching assembly 80 and cash drawer assembly 24. Finally, the resulting smaller mass of the latch mechanism reduces the possibility of accidental release of cash drawer 52.

Although the load compensating latch or latching mechanism 82 in accordance with the present invention is described herein with respect to cash drawer assembly 24, it will be understood by those skilled in the art that the load compensating catch could be used not only in cash drawers, but in other applications having preloaded latches. In general, a device is provided with a preloaded latch when it is desirable to have the latched members of the device automatically separate when the latch is moved from a latching position to a releasing position. For example, a trunk of an automobile may be provided with a preloaded latch so that when the trunk is unlatched, the trunk automatically opens. The load compensating latch or latching mechanism 82 in accordance with the present invention could be easily adapted for use in an automobile trunk, as well as in other applications having preloaded latches.

Latching mechanism 82 in accordance with the present invention is also provided with "dual cam springs" including upper and lower cam springs 182, 184 as shown best in FIG. 12. Use of the dual cam springs minimizes the net forces acting on catch cam 180 outside of the plane of rotation of catch cam 180. Minimizing the "longitudinal" torque applied to catch cam 180 minimizes the wear on catch cam 180 and latching mechanism 82, maximizing the reliability of latching mechanism 82. In addition, upper and lower cam springs 182, 184 are connected to catch cam 180 so that when catch cam moves from the catch position to the release position, after moving "over center," across axis of rotation 242 of catch cam 180, cam springs 182, 184 hold catch cam in the release position when cash drawer 52 is open.

Cash drawer assembly 24 in accordance with the present invention also includes latch-status switch 234 which senses the status of latch 186, as opposed to many conventional cash drawer assemblies which only sense the status of the cash drawer. Such "drawer status sensors" do not indicate when the latching mechanism is latched and locked, but instead merely indicate when the drawer is closed. As a result, while the drawer status sensor could indicate that the drawer is closed, it is possible that the drawer is not locked in the closed position. Latch-status switch 234 in accordance with the present invention indicates when latch 186 is in the locking position, ensuring that cash drawer 52 is locked, when catch cam 180 rotates from the release position to the catch position.

Although the invention has been described in detail with reference to preferred embodiments, additional variations and modifications exist within the scope and spirit of the invention as described and defined in the following claims.

I claim:

1. A cash drawer assembly comprising a housing defining an interior region and having a front wall, a rear wall spaced apart from the front wall and positioned to lie behind the front wall, and spaced-apart first and second side walls connecting the front and rear walls, a cash drawer slidably mounted to the housing for movement between an open position extending in front of the housing and a closed position in the interior region of the housing, a compression spring attached to the rear wall and extending forwardly therefrom, the spring being spaced apart from the first side wall by a first distance and from the second side wall by a second distance, the first distance being generally equal to the second distance, and a tongue attached to the cash drawer and extending rearwardly therefrom, the tongue being spaced apart from the first side wall by the first distance and from the second side wall by the second distance.

2. A latching mechanism for locking a first member to a second member that is yieldably biased away from the first member, the latching mechanism comprising a catch cam rotatably coupled to the first member for rotation about an axis of rotation in a first direction to a release position and in a second direction to a catch position, the catch cam being formed to include a catch, a tongue attached to the second member, the tongue engaging the catch when the second member is in a closed position and the catch cam is in the catch position to lock the second member to the first member, and a spring connected to the catch cam and to the first member to yieldably bias the catch cam in the first direction when the catch cam is in the release position and to yieldably bias the catch cam in the second direction when the catch cam is in the catch position.

3. The latching mechanism of claim 2, wherein the spring has a first end connected to the catch cam at a position spaced apart from the axis of rotation of the catch cam and a second end connected to the housing so that when the catch cam rotates between the catch position and the release position, the spring passes through the axis of rotation of the catch cam.

4. The latching mechanism of claim 3, wherein the spring is a first spring and further comprising a second spring having a first end connected to the catch cam and a second end connected to the housing, the first and second springs being spaced apart and the catch cam being positioned to lie therebetween so that the net forces exerted by the first and second springs out of the plane of rotation of the catch cam are minimized.

5. The latching mechanism of claim 4, wherein the first spring is generally parallel to the second spring.

6. The latching mechanism of claim 2, further comprising a latch pivotably mounted to the first member for movement between a locking position engaging the catch cam to block movement of the catch cam and a releasing position away from the locking position.

7. The latching mechanism of claim 6, wherein the latch includes a locking edge and the catch cam is formed to include a radially outwardly extending locking tab, the locking edge engaging the locking tab when the catch cam is in the catch position and the latch is in the locking position.

8. The latching mechanism of claim 2, wherein the catch cam is formed to include a radially outwardly extending catch, the tongue is formed to include an opening, and the catch is received in the opening and engages the tongue when the catch cam is in the catch position and the latch is in the locking position.

9. A cash drawer assembly comprising a housing defining an interior region and having a front wall, a rear wall spaced apart from the front wall and positioned to lie behind the front wall, and spaced-apart first and second side walls connecting the front and rear walls, the housing further including a back wall spaced apart from the rear wall, the rear wall being positioned to lie between the front and back walls and being formed to include an edge defining an opening, a cash drawer slidably mounted to the housing for movement between an open position extending in front of the housing and a closed position in the interior region of the housing, a compression spring attached to the rear wall and extending forwardly therefrom, the spring being spaced apart from the first side wall by a first distance and from the second side wall by a second distance, the first distance being generally equal to the second distance, and a latching mechanism movable between a locked position holding the cash drawer in the closed position and a release position allowing movement of the cash drawer relative to the housing, the latching mechanism including a tongue attached to the cash drawer and extending rearwardly therefrom through the opening in the rear wall and through an interior region defined by the spring when the cash drawer is in the closed position.

10. The cash drawer assembly of claim 9, further comprising a latching control assembly controlling the movement of the latching mechanism between the locked position and the release position, the latching control assembly including a key lock mechanism coupled to the latching mechanism and including a core mounted to the housing for rotation about an axis of rotation, a first gear coupled to the core for rotation with the core about the axis of rotation of the core, and a second gear rotatably mounted to the housing for rotation about an axis of rotation that is generally orthogonal to the axis of rotation of the core, the second gear being coupled to the first gear so that the second gear rotates in response to rotation of the first gear.

11. The cash drawer assembly of claim 10, wherein the latching control assembly includes a sleeve extending between the second gear and the latching mechanism and a flexible cable received in the sleeve and having a first end connected to the latching mechanism and a second end connected to the second gear so that rotation of the second gear causes the first end of the flexible cable to extend and retract relative to the sleeve.

12. The cash drawer assembly of claim 9, further comprising a latching control assembly controlling the movement of the latching mechanism between the locked position and the release position, the latching control assembly including a sleeve that is fixed relative to the latching mechanism and a flexible cable received by the sleeve and movable in response to user inputs to control the latching mechanism.

13. The cash drawer assembly of claim 9, further comprising a solenoid movable in response to an electronic drawer-release signal to move the latching mechanism from the locked position to the release position and a locked-closed switch coupled to the solenoid and movable between a closed position allowing the transmission of the drawer-release signal to the solenoid and an open position interrupting the transmission of the drawer-release signal to the solenoid so that the solenoid retains the latching mechanism in the locked position when the locked closes switch is in the open position.

14. The cash drawer assembly of claim 9, further comprising a latching control assembly controlling the movement of the latching mechanism between the locked position and the release position, the latching control assembly including a push button mechanism coupled to the latching mechanism and including a button slidably mounted to the housing for movement between an inward depressed position and an outward extended position and a cable having a first end coupled to the button and a second end coupled to the latching mechanism, the cable moving the latching mechanism between the locked position and the release position when the button moves between the extended position and the depressed position.

15. A cash drawer assembly comprising a housing including a top wall and a bottom wall spaced apart from the top wall, the housing defining an interior region and being mountable in a first orientation having the top wall positioned to lie above the bottom wall and a second orientation having the bottom wall positioned to lie above the top wall, and a cash drawer including a drawer pan, the cash drawer being received in the interior region of the housing and slidably coupled to the housing for movement between a closed position and an open position, the drawer pan of the cash drawer being positioned to lie adjacent to the bottom wall when the housing is in the first orientation and adjacent to the top wall when the housing is in the second orientation so that the cash drawer can face upwardly when installed in the housing both when the housing is in the first orientation and when the housing is in the second orientation.

16. The cash drawer assembly of claim 15, further comprising a spring connected to the housing and engaging the cash drawer when the cash drawer is in the closed position to yieldably bias the cash drawer toward the open position, the spring being spaced apart from the first side wall by a first distance and from the second side wall by a second distance which is generally equal to the first distance, and a latching mechanism for latching the cash drawer to the housing when the cash drawer is in the closed position, the latching mechanism including a tongue attached to the cash drawer and spaced apart from the first side wall by the first distance and from the second side wall by the second distance.

17. The cash drawer assembly of claim 16, further comprising a spring connected to the housing and engaging the cash drawer when the cash drawer is in the closed position to yieldably bias the cash drawer toward the open position, the spring being spaced apart from the first side wall by a first distance and from the second side wall by a second distance which is generally equal to the first distance.

18. The cash drawer assembly of claim 16, further comprising a latching mechanism for latching the cash drawer to the housing when the cash drawer is in the closed position, the latching mechanism including a tongue attached to the cash drawer and spaced apart from the first side wall by the first distance and from the second side wall by the second distance.

19. The cash drawer assembly of claim 15, wherein the cash drawer includes spaced-apart first and second side panels connected to the drawer pan and extending upwardly therefrom and the housing includes spaced-apart first and second side walls, each of which is connected to both the top wall and the bottom wall, and further comprising first and second drawer slides connecting the cash drawer to the housing, the first drawer slide including an outer track connected to the first side wall of the housing and an inner track connected to the first side panel of the cash drawer and the second drawer slide including an outer track connected to the second side wall of the housing and an inner track connected to the second side panel of the cash drawer, the inner track of the first side panel being coupled to the outer track of the first side wall when the housing is in the first orientation and the inner track of the second side panel being coupled to the outer track of the first side wall when the housing is in the second orientation.

20. The cash drawer assembly of claim 15, wherein the housing includes a front wall attached to the top wall and the bottom wall and extending therebetween, the front wall being formed to include an edge defining an opening receiving the cash drawer, the edge also defining a first anti-catch tab having a first end adjacent to the opening, a second end adjacent to the top wall, and a ramp extending therebetween and a second anti-catch tab having a first end adjacent to the opening, a second end adjacent to the bottom wall, and a ramp extending therebetween, and further comprising a money tray carried by the cash drawer and engaging the ramp of the first anti-catch tab when the housing is in the first orientation and the cash drawer moves from the closed position to the open position, the money tray engaging the ramp of the second anti-catch tab when the housing is in the second orientation and the cash drawer moves from the closed position to the open position.

21. The cash drawer assembly of claim 15, wherein the housing is formed to include an edge defining a first stop adjacent to the bottom wall, the housing is formed to include an edge defining a second stop adjacent to the top wall, and further comprising a drawer stop pivotably mounted to the cash drawer for movement between a downward stop position and an upward release position, the drawer stop engaging the first stop to stop the movement of the cash drawer away from the closed position when the housing is in the first orientation and the drawer stop is in the stop position, the drawer stop engaging the second stop to stop the movement of the cash drawer away from the closed position when the housing is in the second orientation and the drawer stop is in the stop position.

22. A cash drawer assembly comprising a housing defining an interior region and including a bottom wall having an edge defining a stop, a cash drawer slidably coupled to the housing for movement relative to the housing between a closed position received by the interior region of the housing and an open position having a portion of the drawer extending out of the housing, the cash drawer including a drawer pan and spaced-apart first and second side panels connected to the drawer pan and extending upwardly therefrom, the drawer pan and first and second panels defining an interior region of the drawer, the drawer pan being formed to include a slot, and a drawer stop pivotably mounted to the cash drawer for movement within the slot between a downward stop position and an upward release position, the drawer stop extending from the interior region of the drawer into the interior region of the housing and engaging the stop of the housing to stop the outward movement of the cash drawer relative to the housing when the drawer stop is in the stop position and the cash drawer is in the open position, a portion of the slot in the drawer pan being positioned to lie outside the interior region of the housing to provide access to the drawer stop when the drawer is in the open position and the drawer stop engages the stop of the housing.

23. The cash drawer assembly of claim 22, wherein the drawer stop includes a portion outside the interior region of the drawer and outside the interior region of the housing when the drawer is in the open position and the drawer stop engages the stop of the housing.

24. The cash drawer assembly of claim 23, wherein the drawer stop pivots upwardly from the stop position to the release position away from the stop of the housing when an upward contact force is applied to the portion of the drawer stop outside the interior region of the drawer and outside the interior region of the housing so that the cash drawer can move outwardly relative to the housing past the open position.

25. The cash drawer assembly of claim 22, wherein the drawer stop includes a portion that contacts the drawer pan inside the interior region of the drawer to prevent the drawer stop from pivoting downwardly past the stop position.

26. The cash drawer assembly of claim 22, wherein the drawer stop includes a portion that contacts the drawer pan inside the interior region of the drawer to limit upward pivoting movement of the drawer stop.

27. The cash drawer assembly of claim 22, wherein the drawer stop is coupled to one of the first and second side panels of the drawer for pivoting movement about a pivot axis and the pivot axis is positioned to lie outside the interior region of the housing when the drawer is in the open position and the drawer stop engages the stop of the housing.

28. A cash drawer assembly comprising a housing defining an interior region, a catch cam rotatably mounted to the housing for movement between a catch position and a release position, a cash drawer coupled to the housing and movable relative to the housing between an open position extending from the housing and a closed position received in the interior region of the housing, a tongue mounted to the cash drawer, the tongue engaging the catch cam when the drawer is in the closed position, a drawer spring engaging the drawer and engaging the housing to yieldably bias the cash drawer and the tongue away from the housing and the catch cam, the drawer spring acting through the drawer and the tongue to bias the catch cam in a first direction toward the release position when the drawer is in the closed position and the catch cam is in the catch position, and a cam spring having a first end connected to the housing and a second end connected to the catch cam to yieldably bias the catch cam in a second direction away from the release position when the catch cam is in the catch position to at least partially offset the force applied to the catch cam by the drawer spring.

29. The cash drawer assembly of claim 28, wherein the cam spring yieldably biases the catch cam in the first direction toward the release position when the catch cam is in the release position.

30. The cash drawer assembly of claim 29, wherein the first end of the cam spring is fixed relative to the housing and the second end of the cam spring moves relative to the first end when the catch cam rotates between the catch position and the release position so that the spring passes through the axis of rotation of the catch cam when the catch cam moves between the catch position and the release position.

31. The cash drawer assembly of claim 28, wherein the catch cam includes a locking tab and further comprising a latch pivotably coupled to the housing for movement between a locking position engaging the locking tab and blocking rotation of the catch cam away from the catch position and a release position away from the locking position allowing the catch cam to rotate in the first direction, the first spring acting through the drawer, the tongue, and catch cam to yieldably bias the locking tab against the latch, and the second spring yieldably biasing the locking tab away from the latch to reduce the force exerted by the locking tab against the latch.

32. The cash drawer assembly of claim 31, further comprising a solenoid coupled to the latch for pivoting the latch from the locking position to the releasing position in response to a drawer-release signal and a locked-closed switch coupled to the solenoid and movable to an open position interrupting the transmission of the drawer-release signal to the solenoid so that the cash drawer can be electronically locked in the closed position.

33. The cash drawer assembly of claim 31, further comprising a latch-status switch including a shell mounted to the housing and a button mounted to the shell for movement relative to the shell between an inward retracted position and an outward extended position, the button engaging the latch and movable therewith, the latch-status switch providing a signal in response to the position of the latch and the position of the button.

34. The cash drawer assembly of claim 33, wherein the latch-status switch further includes a spring yieldably biasing the button toward the extended position, the spring of the latch-status switch also yieldably biasing the latch toward the locking position so that the latch moves to the locking position when the catch cam moves to the catch position.

35. The cash drawer assembly of claim 28, wherein the cam spring is a first cam spring and further comprising a second cam spring spaced apart from the first cam spring and having a first end connected to the housing and a second end connected to the catch cam to yieldably bias the catch cam in the second direction when the catch cam is in the catch position.

36. The cash drawer assembly of claim 35, wherein the catch cam is positioned to lie between the first and second cam springs.

37. The cash drawer assembly of claim 35, further comprising a latch pivotably mounted to the housing for movement between a locking position blocking rotation of the catch cam away from the catch position and a releasing position allowing rotation of the catch cam away from the catch position and toward the release position.

38. The cash drawer assembly of claim 37, wherein the cable engages the latch and retains the latch in the releasing position when the cable is in the locked-open position.

39. The cash drawer assembly of claim 37, further comprising a solenoid mounted to the housing and coupled to the latch for pivoting the latch to the releasing position in response to a drawer-release signal and a locked-closed switch coupled to the solenoid and movable between a closed position allowing the transmission of the drawer-release signal to the solenoid and an open position interrupting the transmission of the drawer-release signal to the solenoid, the cable moving the locked-closed switch to the open position when the cable is in the locked-closed position.

40. The cash drawer assembly of claim 28, further comprising a latch control assembly including a cable movable between a locked-closed position causing the movement of catch cam away from the catch position to be blocked and a locked-open position preventing the blocking of movement of the catch cam away from the catch position.

41. The cash drawer assembly of claim 40, wherein the latch control assembly includes a key lock mechanism rotatably mounted to the housing and coupled to the cable so that rotation of the key lock mechanism moves the cable between the locked-closed position and the locked-open position.

42. A cash drawer assembly comprising a housing defining an interior region and having a front wall, a rear wall spaced apart from the front wall and positioned to lie behind the front wall, and spaced-apart first and second side walls connecting the front and rear walls, a cash drawer slidably mounted to the housing for movement between an open position extending in front of the housing and a closed position in the interior region of the housing, a compression spring attached to the rear wall and extending forwardly therefrom, the spring being spaced apart from the first side wall by a first distance and from the second side wall by a second distance, the first distance being generally equal to the second distance, a tongue attached to the cash drawer and extending rearwardly therefrom, the tongue being spaced apart from the first side wall by the first distance and from the second side wall by the second distance, the compression spring being a cylindrically-shaped spring defining a cylindrically-shaped interior region and the tongue moving axially through the interior region of the spring when the cash drawer moves to the closed position.

43. A cash drawer assembly comprising a housing defining an interior region and having a front wall, a rear wall spaced apart from the front wall and positioned to lie behind the front wall, and spaced-apart first and second side walls connecting the front and rear walls, a cash drawer slidably mounted to the housing for movement between an open position extending in front of the housing and a closed position in the interior region of the housing, a compression spring attached to the rear wall and extending forwardly therefrom, the spring being spaced apart from the first side wall by a first distance and from the second side wall by a second distance, the first distance being generally equal to the second distance, a tongue attached to the cash drawer and extending rearwardly therefrom, the tongue being spaced apart from the first side wall by the first distance and from the second side wall by the second distance, a latching mechanism movable between a locked position holding the cash drawer in the closed position and a release position allowing movement of the cash drawer relative to the housing, the latching mechanism including a tongue attached to the cash drawer and extending rearwardly therefrom through an interior region defined by the spring when the cash drawer is in the closed position.

44. A cash drawer assembly comprising a housing defining an interior region and having a front wall, a rear wall spaced apart from the front wall and positioned to lie behind the front wall, and spaced-apart first and second side walls connecting the front and rear walls, a cash drawer slidably mounted to the housing for movement between an open position extending in front of the housing and a closed position in the interior region of the housing, a compression spring attached to the rear wall and extending forwardly therefrom, the spring being spaced apart from the first side wall by a first distance and from the second side wall by a second distance, the first distance being generally equal to the second distance, the cash drawer including first and second spaced-apart side panels, a first slide having an outer track mounted to the first side wall and an inner track mounted to the first side panel and a second slide having an outer track mounted to the second side wall and an inner track mounted to the second side panel, the first and second slides cooperating to mount the cash drawer to the housing, the inner track of the first side panel being received by the outer track of the first side wall and the inner track of the second side panel being received by the outer track of the second side wall when the housing is oriented for mounting to an upwardly facing surface and the inner track of the first side panel being received by the outer track of the second side wall and the inner track of the second side panels being received by the outer track of the first side wall when the housing is oriented for mounting to a downwardly-facing surface.

45. A cash drawer assembly comprising a housing defining an interior region and having a front wall, a rear wall spaced apart from the front wall and positioned to lie behind the front wall, and spaced-apart first and second side walls connecting the front and rear walls, a cash drawer slidably mounted to the housing for movement between an open position extending in front of the housing and a closed position in the interior region of the housing, a compression spring attached to the rear wall and extending forwardly therefrom, the spring being spaced apart from the first side wall by a first distance and from the second side wall by a second distance, the first distance being generally equal to the second distance, a tongue attached to the cash drawer and extending rearwardly therefrom, the tonic being spaced apart from the first side wall by the first distance and from the second side wall by the second distance, the rear wall including an edge defining an opening spaced apart from the first side wall by the first distance and from the second side wall by the second distance, the tongue being received by the opening when the cash drawer is in the closed position.

46. The cash drawer assembly of claim 45, wherein the housing includes a top wall connected to the front wall, the rear wall, and the first and second side walls and a bottom wall spaced apart from the top wall and connected to each of the front, rear, first side, and second side walls and the cash drawer includes a drawer pan having an upwardly-facing surface, the opening in the rear wall and the tongue each being spaced apart from the top wall of the housing by a third distance and from the bottom wall of the housing by a fourth distance, the third distance being generally equal to the fourth distance so that the cash drawer can be received in the housing with the surface of the drawer pan facing upwardly both when the housing is oriented having top wall positioned to lie above the bottom wall and when the housing is oriented having the top wall positioned to lie beneath the bottom wall.

47. The cash drawer assembly of claim 45, wherein the compression spring is a cylindrically-shaped spring defining a cylindrically-shaped interior region and the tongue moves axially through the interior region of the spring to the opening in the rear wall when the cash drawer moves to the closed position.

* * * * *